United States Patent [19]

Smith

[11] Patent Number: 4,741,188

[45] Date of Patent: May 3, 1988

[54] REKEYABLE MASTER AND USER LOCK SYSTEM WITH HIGH SECURITY FEATURES

[76] Inventor: Jerry R. Smith, 5690 W. Rowland Ave., Littleton, Colo. 80123

[21] Appl. No.: 755,471

[22] Filed: Jul. 16, 1985

[51] Int. Cl.[4] ..... E05B 25/00

[52] U.S. Cl. ..... 70/383; 70/384

[58] Field of Search ..... 70/382, 383, 384, 385, 70/376, 378, 364 A, 358

[56] References Cited

U.S. PATENT DOCUMENTS

| | | | |
|---|---|---|---|
| 1,650,568 | 11/1927 | Hurd . | |
| 1,953,535 | 4/1934 | Hurd | 70/378 |
| 2,252,966 | 8/1941 | Fogelson | 70/378 |
| 3,070,987 | 1/1963 | Baker | 70/383 |
| 3,073,146 | 1/1963 | Patriquin | 70/383 |
| 3,078,705 | 2/1963 | Morrison, Jr. | 70/383 |
| 3,125,878 | 3/1964 | Gutman | 70/383 |
| 3,175,378 | 3/1965 | Russell | 70/383 |
| 3,234,768 | 2/1966 | Russell | 70/383 |
| 3,563,071 | 2/1971 | Barger | 70/383 |
| 4,103,526 | 8/1981 | Surko | 70/378 |
| 4,412,437 | 11/1983 | Smith | 70/338 |
| 4,440,009 | 4/1984 | Smith | 70/385 |

*Primary Examiner*—Robert L. Wolfe

*Attorney, Agent, or Firm*—James R. Young

[57] ABSTRACT

Methods and apparatus are disclosed for multiple level user and master key lock rekeying changes externally by the use of appropriately bidded level change keys. Several variations of methods and apparatus for removing user level change wafers to rekey user levels independent of master levels and to rekey master levels independent of user levels are disclosed. Some of the apparatus are suitable for locks wherein the cylinder is rotatable at 180°, and other embodiments are disclosed for locks wherein cylinder rotation is limited to less than 180°. Further, apparatus for enhancing the security of such rekeyable locks are disclosed.

79 Claims, 14 Drawing Sheets

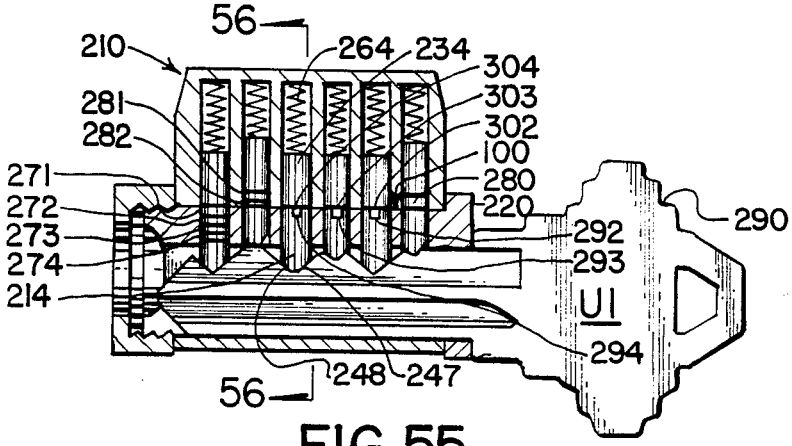
FIG. 55
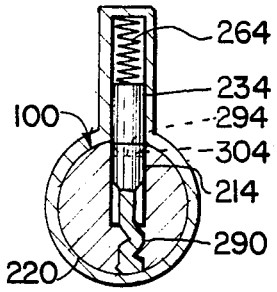
FIG. 56
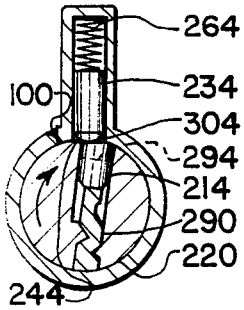
FIG. 57
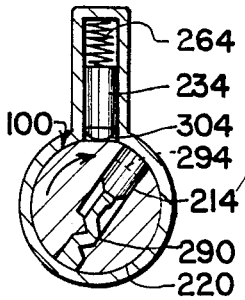
FIG. 58
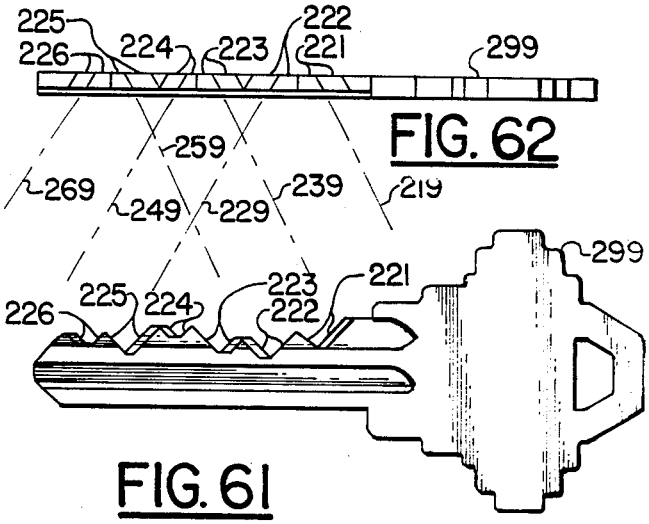
FIG. 62
FIG. 61
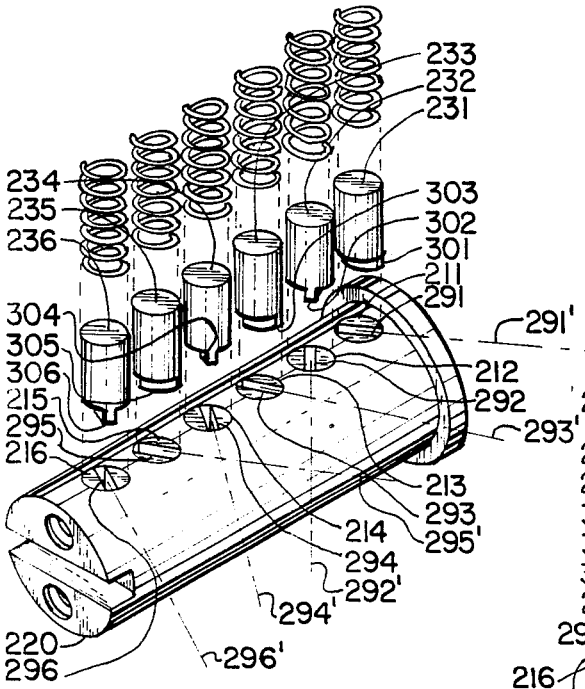
FIG. 59
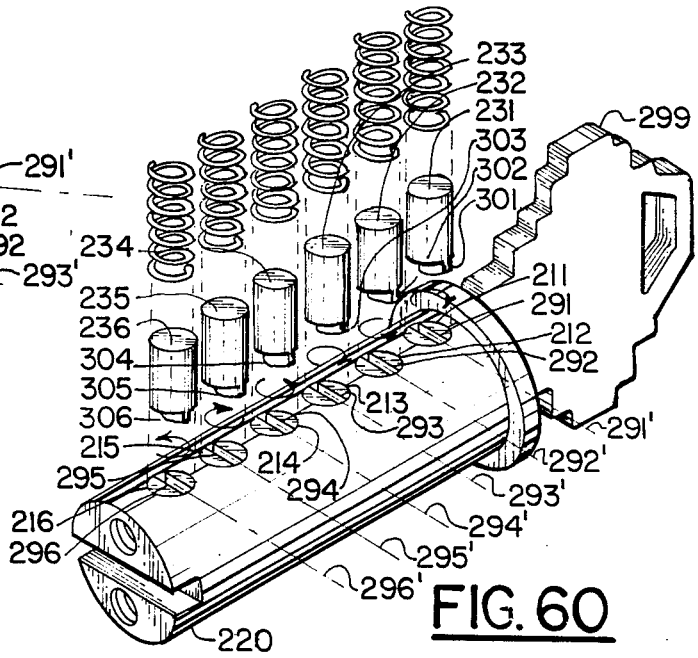
FIG. 60

REKEYABLE MASTER AND USER LOCK SYSTEM WITH HIGH SECURITY FEATURES

BACKGROUND OF THE INVENTION

1. Field of the Invention

This invention relates generally to cyclinder locks, and more specifically to a rekeyable lock method and apparatus that wherein a master key lock system can be rekeyed externally for different master level keys as well as for different user level keys.

2. Description of the Prior Art

Lock devices generally known as tumbler pin cylinder locks have been widely used for many years to secure door locks, padlocks, and many other types of locks. More recently, variations and improvements have been developed for rekeying such tumbler pin cylinder locks without having to disassemble the locks. The following U.S. patents are examples of such externally rekeyable or changeable combination locks: U.S. Pat. No. 3,078,705, issueed to D. Morrison, Jr.; U.S. Pat. No. 3,070,987, issued to A. R. Baker, et al; U.S. Pat. No. 3,125,878, issued to L. Gutman; U.S. Pat. No. 3,563,071, issued to L. N. Barger; U.S. Pat. No. 3,175,378, issued to F. J. Russell; U.S. Pat. No. 3,073,146, issued to G. P. Patriquin; and U.S. Pat. No. 1,650,568, issued to N. B. Hurd.

The Morrison patent, U.S. Pat. No. 3,078,705, as well as the Republic of Germany Patent No. DE 3040646AL, issued to F. Muus on June 19, 1981, disclose a method and apparatus for rekeying tumbler pin cylinder locks by utilizing a short temporary pin or wafer between the driver and tumbler pins to create a different shear line that is alignable by the appropriate key bitting with the shear line between the lock cylinder and housing to allow the cylinder to be rotated by the key. When the lock is to be rekyed, a special disabling key is inserted into the keyway in the cylinder. This special disabling key and bitting thereon cut to push the wafer into the top chamber and a notch in its spine opposite the bitting to receive and capture the wafer when the key and cylinder are rotated 180 degrees. The captured wafer is then extracted and expelled from the lock when the special key is pulled out of the keyway.

While the Morrison and Muus devices are effective to rekey the lock, there are several problems with its use. One of the most significant of these problems is that once the temporary pin or wafer is removed from the lock as taught by Morrison and Muus, one dare not reinsert the special disabling key into the keyway and turn the cylinder with it. If this is done, the top or driver pin in the top chamber will fall into the notch in the spine of the special disabling key. In that position, the cylinder cannot be turned again, and the special disabling key cannot be withdrawn. It remains stuck in that position, and the lock is rendered useless. It is, for practical purposes, ruined.

The only way to prevent this situation from occurring is to either destroy the special disabling key after its first use or take other elaborate precautionary measures to insure that it is not again mistakenly used in the lock. Unfortunately, many lock users do not take these precautions.

My improved rekeyable lock invention, on which my U.S. Pat. No. 4,412,437 was issued on Nov. 3, 1983, was an attempt to solve this problem. It utilizes a short temporary pin or wafer that is smaller in diameter than the main driver and tumbler pins in the lock. It also utilizes a notch in the spine of the special disabling or change key that is sized to capture the smaller diameter wafer, but which in combination with the keyway is too small to receive the larger diameter driver or top pin. Thus, the larger driver pin is physically prevented from entering the notch in the disabling or change key, even if that same disabling or change key is inserted into the keyway and turned after the wafer has been removed. While this improvement has eliminated the problem of irretrievably sticking the special disabling or change key in the lock, it does still have some unique problems of its own. The most significant of such problems is that the smaller diameter wafers have a tendency to flip over on their sides in the chamber, thus affecting the proper functioning of the lock.

The Morrison and Muus patents also are used only as construction keys wherein one key change is taught. My improved rekeyable lock invention in my issued U.S. Pat. No. 4,412,437 expands such usage to include several levels of key changes for users. However, all such prior art patents have been limited to apparatus in which either user levels or master levels could be changed but not both.

More specifically, a master key lock system is one in which a master key can be used to unlock all of a whole group of locks, each of which requires a different user key. Such systems are often used by building owners to give the owner, maintenance, or security people ready access to many premises in the building, while the tenant's or user's key can only provide access to a specific one of such premises. The purpose of the master key is to reduce the number of keys the owner, maintenance, or security people must carry or maintain. However, while such master key systems increase efficiency, the existence of the master keys also reduce security. If a master key is lost, stolen, or secretly copied, every tenant's or user's premises is more susceptible to unauthorized entry. If security is to be maintained, the owner must change all of the locks in the group for which the master key is operable. Such changing of many locks was a costly procedure prior to this invention, so there was often the temptation to forego this expense and hope for the best. Unfortunately, from this approach, losses could occur, and the owner could incur substantial legal liabilities. Therefore, it has been found desirable to be able to provide high security rekeyable locks in which both user level keying combination and master level keying combinations can be changed independently of each other and without affecting the operation or keying of the other.

Another fact that exacerbates the security problems with master key systems, as well as with rekeyable locks, is that these master and rekeying functions operate off a plurality of different shear planes between the driver and service pins of the lock. Unfortunately, the more shear planes, the easier it is to "pick" the lock and gain unauthorized entry. A number of improvements over the prior art are required to provide a lock system that is rekeyable for both the user and the master levels and is easy enough to use for ordinary individuals, yet reliable and secure enough to provide the protection for which locks are used.

Another limitation of the prior art rekeyable locks, such as the Morrison and Muus patents, as well as my prior art apparatus in my U.S. Pat. No. 4,412,437, is that the cylinders and keys in those locks have to be rotated 180 degrees in order to align the removal notch in the key spine with the temporary pin or wafer in order to capture and remove the wafer from the lock. Unfortunately, the latch mechanisms to which many of these locks are connected in doors, padlocks, and other devices, do not accomodate or allow 180 degress rotation of the lock cylinder. Such installations cannot utilize the rekeyable locks shown in the Morrison or Muus patents or in that rekeyable lock shown in my U.S. Pat. No. 4,412,437. Several other prior art patents, such as those issued to Patriquin, Russell, Baer, Barger, and Hurd, dislcose externally rekeyable locks that do not require 180 degree rotation of the cylinder, but they only show one available rekeying operation. Therefore, there is still a need for a rekayble lock that can be rekeyed a multiple of times externally for use with multiple user level and/or master level rekeying.

In summary, the prior art rekeyable locks do not provide multiple user level and master level rekeyable options. Further, they do not provide fool-proof mechanisms for users or sufficient security from being picked or opened by unauthorized persons, especially in the multiple level rekeyable configurations.

To further achieve the foregoing and other objects in accordance with the purpose of this invention as well as to facilitate practice of this invention, this invention also includes methods of assembling and using the lock apparatus summerized above for rekeying operations and increasing security of such lock.

SUMMARY OF THE INVENTION

Accordingly, it is a general object of this invention to provide a multiple user level and/or master level externally rekeyable lock.

It is also a general object of this invention to provide a more secure lock apparatus, especially where such lock apparatus is configured as a multiple level rekeyable lock.

A more specific object of this invention is to provide a tumbler pin cylinder lock that is rekeyable externally to change multiple user levels as well as multiple master levels.

A further specific object of this invention is to provide such a lock wherein the user level changes are independent of, and do not affect, the master key configurations and vice versa.

Another specific object of this invention is to provide an externally rekeyable tumbler pin cylinder lock in which full size removeable wafers are used in combination with a special key adapted for removing the wafer for such rekeying, and wherein reinsertion and reuse of the special key does not result in sticking the key in the lock and rendering the lock unusable.

An additional object of this invention is to provide a multiple level externally rekeyable lock that does not require 180 degree cylinder rotation for rekeying.

Still another object of this invention is to provide increased security against picking or unauthorized opening of locks, especially multiple level rekeyable locks according to this invention.

A further specific object of this invention is to provide such increased security by apparatus that inhibits or eliminates detection of shear plane alignment for the individual tumbler pins in a tumbler pin cylinder lock.

Additional objects, advantages, and novel features of the invention are set forth in part in the description that follows, and in part will become apparent to those skilled in the art upon examination of the following specification or may be learned by the practice of the invention. The objects and advantages of the invention may be realized and attained by means of the instrumentalities and in combinations pointed out in the appended claims.

To achieve the foregoing and other objects in accordance with the purpose of the present invention as well as to facilitate the practice of this invention, the apparatus of this invention may comprise a tumbler pin lock that has a plurality of level change pin wafers in one pin chamber for a number of user level keying options and a plurality of level change pin wafers in another pin chamber for a number of master level keying options. In order to separate the master key system from the user key system, the user keys generally work off the shear line at the bottom of the driver pin and over the user level change wafers in the chamber containing the user level change wafers and off the shear line at the top of the service pin and under the master level change wafers in the chamber containing the master level change wafers. The master key, on the other hand, works off the shear line at the top of the service pin and under the user level change wafers in the chamber containing the user level change wafers and off the bottom of the driver pin and over the master level change wafers in the chamber containing the master level change wafers. An additional permanent master pin wafer is also provided in another chamber of the lock to keep the master and user keys distinct after all the level change wafers have been removed. The apparatus also has bevelled edges along the keyway in the cylinder for camming the driver pins out of the ejection notches in the spines of the level change keys.

For additional security, the level change wafers are provided in a unitary rigid stack. The wafers in the stack are secured by an adhesive or by a rigid core of frangible material through the centers of the wafers or by a rigid sleeve of frangible material around the peripheral surfaces of the wafers. The solid frangible material is preferably graphite to lubricate the lock.

High security embodiments of the invention include interlocking cotters and slots on the bottoms of driver pins and tops of service pins, respectively, that have to be oriented transverse to the longitudinal axis of the cylinder in order for the cylinder to rotate. The cotters can have rounded cam surfaces on the bottom, or they can be squared. If they are squared, adjacent slots in the cylinder are provided to cam the cotters out of the pin chambers in the cylinder so the cylinder can rotate to open the lock.

For locks that cannot accommodate 180° rotation of the cylinder, this invention also includes alternate embodiments for rekeyable multiple level user and master levels according to the principles of this invention. In one such embodiment, ejection holes through the lock body are provided adjacent the pin chambers through which level change wafers are ejected by rotation of the cylinder. Recessed troughs in the cylinder, either connected to the pin chamber therein or angularly spaced apart from the pin chamber, provide positive engagement to eject the level change wafers through the ejection holes and out of the lock. A blocking wafer larger than the ejection hole is also provided to retain master level change wafers in the lock during user level key operations. Another embodiment of this invention has change wafer capture holes in the cylinder deep enough to capture and retain a mutliple of level change wafers. The capture holes and level change wafers are smaller in diameter than the driver pins, and blocking wafers larger in diameter than the capture holes are provided to block level change wafers out of the captive holes when level changes are not desired.

BRIEF DESCRIPTION OF THE DRAWINGS

The accompanying drawings, which are incorporated in, and form a part hereof, the specifications, illustrate the preferred embodiments of the present invention, and together with the description, serve to explain the principles of the invention. In the drawings:

FIG. 53 is a side elevation view of a typical service pin utilized in the high security multiple user and master key system of FIGS. 49 and 50;

FIG. 56 is a cross-sectional view of the high security embodiment multiple level user and master key system of the present invention taken along line 56—56 in FIG. 55;

FIG. 57 is a cross-sectional view similar to that shown in FIG. 56, but with the cylinder rotated several degrees to illustrate the upward camming on the driver pin by the cylinder;

FIG. 58 is a cross-sectional view of the high security multiple level user and master key system similar to FIGS. 56 and 57, but with the cylinder rotated an additional several degrees to illustrate the operational movement thereof with the driver pin cammed out of the cylinder pin hole;

FIG. 59 is an isometric view of the high security embodiment of this invention shown in FIGS. 49 and 50, but utilized only for the high security function without the multiple level user and master key system;

FIG. 60 is an isometric view of the embodiment of the high security lock system shown in FIG. 59 with an appropriately cut and bitted key positioned therein to open the lock;

FIG. 61 is a side elevation view of an appropriately cut and configured key to open the lock as shown in FIG. 60;

FIG. 62 is a top plan view of the key illustrated in FIG. 61;

DETAILED DESCRIPTION OF THE PREFERRED EMBODIMENT

Figure 1:
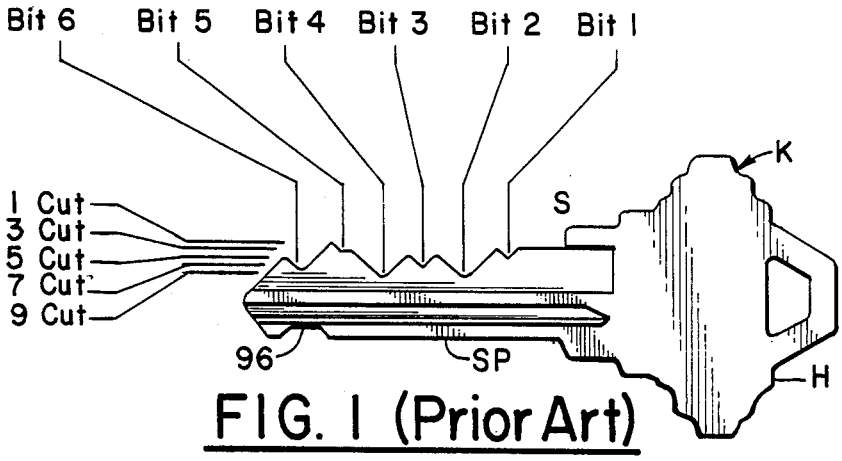
FIG. 1 (Prior Art)
FIG. 1 is a side elvation view of a key that is typical of the key utilized in the present invention and illustrating the conventional terminology for bits and cuts as used in the description of this invention.

This invention is directed to rekeyable multiple level user and master key lock systems, including high security embodiments thereof. Throughout the description of this invention in this specification, various configurations of keys are described to illustrate the structure and operation of this invention. Therefore, in order to provide standard terms for this description and to minimize repetitious definitions of key structures, FIG. 1 is included to illustrate a typical key K as used in this invention. The structure of key K is known in the prior art and has a head or handle portion H to facilitate grasping by a person's fingers and an elongated shank S extending therefrom. On one side of the shank S is a typical bitting configuration for a six-pin cylinder lock. The bit positions in the shank S for corresponding pin positions are conventionally numbered from 1 to 6 beginning at the end of the handle H and extending outwardly to the distal end of the shank S. Thus, the first position or bit 1 is nearest the handle, and bit 6 is the farthest from the handle H.

The vertical depth of each bit is customarily called a "cut". The cuts generally are indicated as increments of whole numbers designating the relative depth of the cuts for each bit. It is customary for such cuts to range from 0 to 9, with each increment being approximately 0.015 inches. Under this convention, as illustrated in FIG. 1, a 0 cut has no vertical depth from the side surface of the shank S. A 1 cut has approximately 0.015 inches of material removed from a bit space, a 2 cut has approximately 0.030 inches of material removed from the bit space, thus proceeding to a 9 cut which has approximately 0.135 inches of material removed from each space.

For purposes of this invention, removable pin wafers are positioned in the pin chambers of a tumbler pin lock for setting the keying combination of the lock. While it is possible for such wafers to be sized corresponding to single cut increments in thickness, such thin wafers are not very practical in durable, reliable rekeyable lock systems. It has been found preferable to size these removeable wafers with a thickness corresponding to at least 2 increments of cut. Thus, FIG. 1 illustrates only the odd numbered cuts 1, 3, 5, 7, and 9.

For simplicity, in descriptions of individual bits on the key bitting configurations to be described herein, each bit will be described with the format of the "bit number/cut number." For example, a first bit position with a 1 cut will be described as B1/1C. Likewise, a sixth bit with a 9 cut will be described as B6/9C.

One of the significant concepts of this invention is a rekeyable tumbler pin cylinder type lock system which includes both a plurality of user level rekeying options as well as a plurality of master level rekeying options, wherein such rekeying options are attainable externally without having to disassemble the lock. Further, it is significant that the user levels and master levels can be rekeyed according to this invention independent of each other. In other words, this lock system can be operated or opened with a user key as well as with a differently configured master key. The keying combination for the user key can be changed externally, thus changing the lock to require a different user key without affecting the operation of the master key. Likewise, the master key level can be changed or rekeyed externally to require a different master key without affecting the operation of the user key. A number of user key level rekeying options are available as well as a number of master rekeying level options being available.

Figure 4:
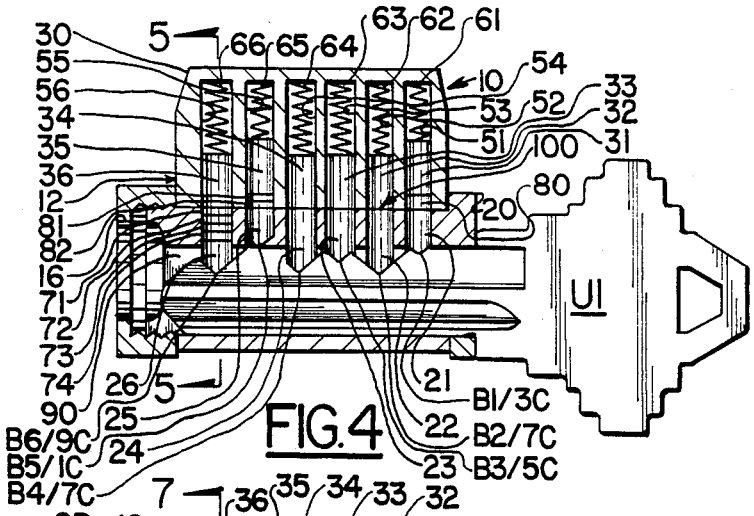
FIG. 4 is a cross-sectional view of the multiple level user and master key system of the present invention with the first level user key inserted therein.
Figure 6:
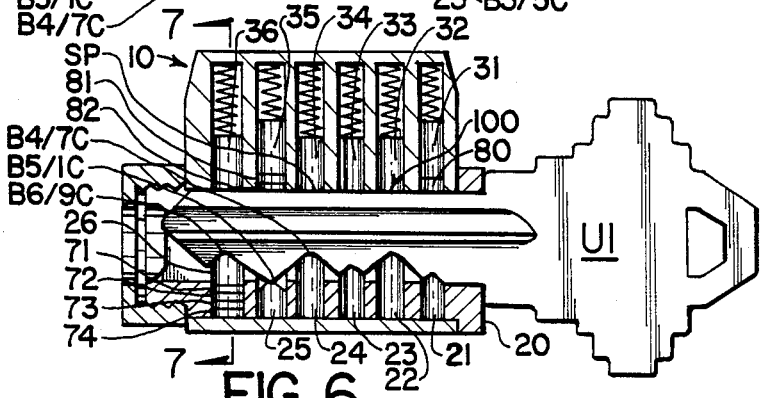
FIG. 6 is a cross-sectional view of the multiple level user and master key system of the present invention with the first level user key positioned therein and rotated 180°.

The basic form and structure of this multiple level user and master rekeyable lock is best illustrated initially by reference to FIGS. 4 and 6. FIG. 4 is a cross-sectional view in side elevation of the rekeyable lock 10 of this invention with a first level user key U1 positioned therein. FIG. 6 is a similar cross-sectional view of the rekeyable multiple level and master key lock according to the present invention with the first level user key U1 in the cylinder 20 rotated 180°, as it is operated in a normal manner.

The lock 10 includes a lock housing or shell 12 having an upper chamber 30 and a lower section 14. The upper chamber 30 has a plurality of vertical bore holes 51, 52, 53, 54, 55, 56 extending upwardly therein in spaced apart relation to each other from the lower housing 14. Each bore hole or upper chamber 51, 52, 53, 54, 55, 56 has positioned therein respectively slideable driver pins 31, 32, 33, 34, 35, 36, which are biased downwardly by respective coiled compression springs 61, 62, 63, 64, 65, 66. The lower chamber 14 is essentially cylindrical and is adapted to slideably and rotatably receive therein the lock rotor or cylinder 20. The lock cylinder 20 is retained in the lower housing portion 14 by an end cap 25 screwed onto the end of the cylinder 20.

The lock cylinder 20 has a keyway 90 extending longitudinally therethrough, which is adapted to slideably receive therein the shank S of a key, such as the first level user key U1 illustrated in FIG. 4. The cylinder 20 also includes six transverse bores or chambers in which are slideably positioned respectively the service pins 21, 22, 23, 24, 25, 26. These service pins are sized such that when they register in the appropriately aligned bittings of the key U1, they raise the driver pins 61, 62, 63, 64, 65, 66 therein to appropriate heights such that the interfacing surfaces between the driver pins and service pins align with the shear line 100. The shear line 100 is defined by the circumferential interface between the cylinder 20 and the housing 14. When such alignment is obtained, of course, the cylinder 20 can be rotated to operate the particular latch mechanism (not shown) to which the lock 10 is connected.

The above description is essentially background information to aid in the understanding of the structure and operation of this invention. The significant features of this invention for purposes of the multiple level user and master key rekeying options are illustrated in FIG. 4 as the stack of four short pins or wwfers 71, 72, 73, 74, the second stack of two short pins or wafers 81, 82, and the single wafer 80. It is significant to note that with the first level user key U1 positioned in the keyway 90, the stack of four user level change wafers 71, 72, 73, 74 are all positioned below the shear line 100, while the stack of two master level change wafers 81, 82 are both positioned above the shear line 100.

In this illustration, the four wafers 71, 72, 73, 74 are used to rekey the user level keying combinations and are positioned in the cylinder 20 between the sixth service pin 26 and the sixth driver pin 36. The wafers 81, 82 are considered the master key rekeying wafers and are positioned between the fifth service pin 25 and the fifth driver pin 35. The permanent master wafer 80 is positioned between the first service pin 21 and the first driver pin 31 and is illustrated above the shear line 100 with the first level user key U1 in position. It should be noted that while these wafers are positioned in the first, fifth, and sixth positions as described above, they can be positioned in any of the other positions or chambers as well. There can also be different numbers of these user and master level change wafers, as long as there is sufficient space in the pin chambers to accommodate them. However, for the purposes of describing this invention, the user key U1 is considered to work off the shear line at the top of the stack of user level wafers 71, 72, 73, 74 and off the shear line at the bottom of the stack of master level wafers 81, 82. It will also be seen in the description below that the master keys, on the other hand, work off the shear line at the bottom of the stack of user wafers 71, 72, 73, 74 and the top of the master wafers 81, 82. However, it is understood that these working shear lines can be inverted such that the user keys work off the shear lines at the bottom of the user wafers and the top of the master wafers while the master keys work off the shear lines at the top of the user wafers and the bottom of the master wafers if desired. Likewise, while this description will proceed with the permanent master wafer 80 positioned above the shear line 100 for the user keys and below the shear line 100 for the master keys, this configuration could be inverted as well.

Also, for the purpose of describing this invention, four user wafers 71, 72, 73, 74 have been chosen to provide five different user level keying combinations and two master wafers 81, 82 provide three different master level keying combinations. These numbers of wafers can be varied to provide different numbers of keying combinations, but this illustration is considered to be adequate and practical for most applications.

Figure 5:
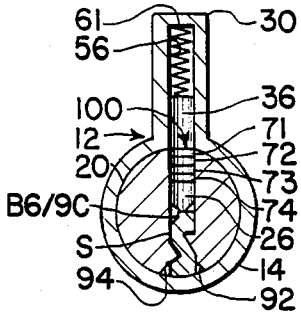
FIG. 5 is a cross-sectional view of the multiple level user and master key system of the present invention taken along line 5—5 of FIG. 4.

It is also noted, for purposes of this description, that each user and master wafer is approximately the thickness of two level cuts in the key. Therefore, this first user level key U1 is illustrated with the following bitting: B1/3C, B2/7C, B3/5C, B4/7C, B5/1C, and B6/9C. (For a definition of these designations of bit positions and cuts, see the explanation above.) As shown in FIGS. 4 and 5, this key bitting combination of the first level user key U1 is effective to position all of the user wafers 71, 72, 73, 74 below the shear line 100 and the master wafers 81, 82, as well as the permanent master wafer 80, above the shear line 100. Also, as illustrated in FIGS. 4 and 5, this lock combination with this first level user key U1 is in a position to be opened, i.e., the cylinder 20 can be rotated by the key U1.

Figure 7:
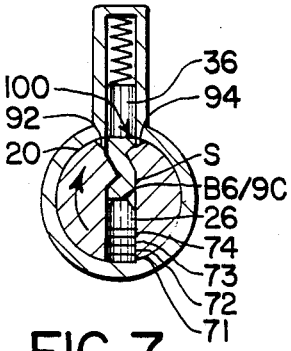
FIG. 7 is a cross-sectional view of the multiple level user and master key system of the present invention taken along line 7—7 of FIG. 6.

FIGS. 6 and 7 illustrate the lock described above and shown in FIG. 4, but with the first level user key U1 and the cylinder 20 rotated 180°, as the lock 10 is operated or opened. It can be seen in the positions illustrated in FIGS. 6 and 7 that when the cylinder is rotated 180°, the spine SP of the key shank holds the driver pins 31, 32, 33, 34, 35, 36 with their respective bottom surfaces at the shear line 100 to allow continued operation of the lock from this 180° rotated position. Therefore, the user level key U1 can then be rotated from the position illustrated in FIGS. 6 and 7 back to its original position as illustrated in FIGS. 4 and 5 when the lock has been opened and the user desires to pull the key U1 out of the cylinder 20.

Figure 8:
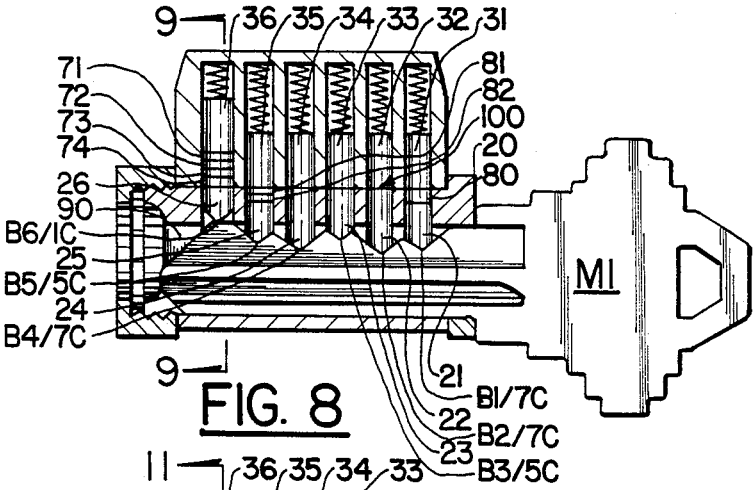
FIG. 8 is a cross-sectional view of the multiple level user and master key system of the present invention with the first level master key positioned therein.
Figure 9:
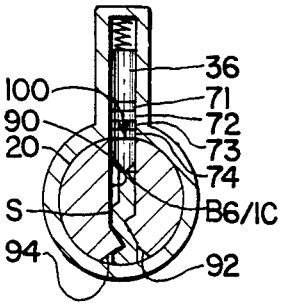
FIG. 9 is a cross-sectional view of the multiple level user and master key system of the present invention taken along line 9—9 of FIG. 8.

The operation of the first level master key M1 is illustrated in FIGS. 8 and 9, wherein the first level master key M1 is shown inserted into the keyway 90 in cylinder 20. This first level master key M1 has the following bitting configuration: B1/7C, B2/7C, B3/5C, B4/7C, B5/5C, and B6/1C. In this configuration, as briefly described above, all of the user level wafers 71, 72, 73, 74 are raised by the sixth bit B6/1C into the upper chamber above the shear line 100. The fifth bit B5/5C allows the master level wafers 81, 82 to drop below the shear line 100. Thus, as mentioned above, when this first level master key M1 is used in the lock 10, it works off the shear line at the top of the service pin 26 and the bottom of the stack of user wafers 71, 72, 73, 74 and off the shear line at the bottom of the drive pin 35 and the top of the master level wafers 81, 82.

Figure 10:
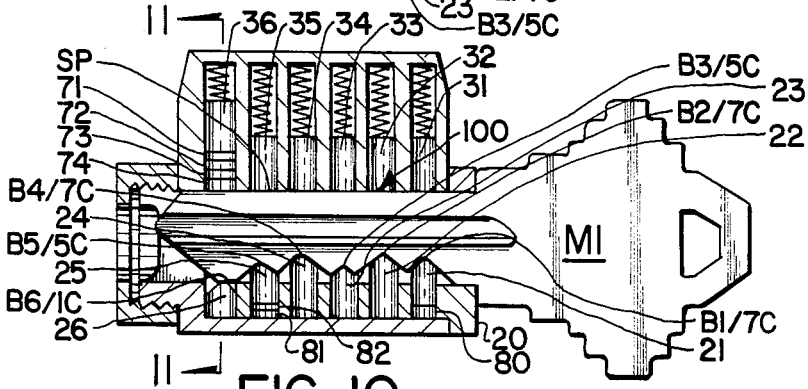
FIG. 10 is a cross-sectional view of the multiple level user and master key system of the present invention with the first level master key positioned therein and rotated 180°.
Figure 11:
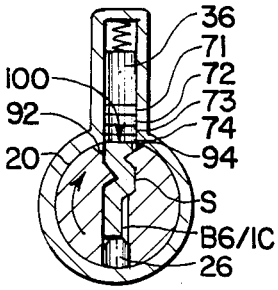
FIG. 11 is a cross-sectional view of the multiple level user and master key system of the present invention taken along line 11—11 of FIG. 10.

The first bit B1/7C of this first level master key M1 allows the permanent master wafer 80 to drop below the shear line 100 so that it works off the shear line at the bottom of the driver pin 31 and the top of the permanent master wafer 80. The illustrations herein show the permanent master wafer 80 as having a thickness equal to four cut increments, thus requiring the difference of four cut levels between the first bit B1/3C and the user key U1 and the first bit B1/7C and the master key M1. As shown in FIGS. 8 and 9, this bitting combination of the master key M1 aligns all of the shear lines in each of the pin chambers so that the cylinder 20 can be rotated to open the lock, which rotation is shown in FIGS. 10 and 11. As illustrated in FIGS. 10 and 11, the spine SP of the first level master key M1 maintains the shear line 100 when the cylinder is rotated 180° to allow the cylinder 20 to again be rotated away from this open position to the closed position where the master key M1 can be pulled out of the cylinder 20.

Figure 12:
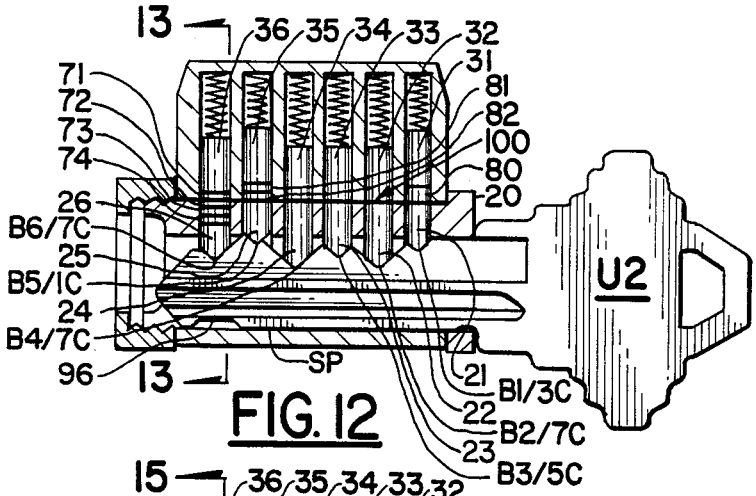
FIG. 12 is a cross-sectional view of the multiple level user and master key system of the present invention with the second level key positioned therein.
Figure 13:
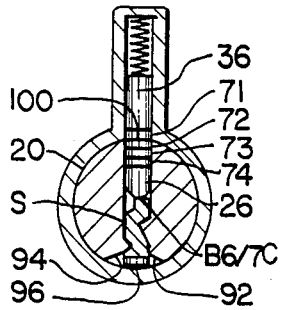
FIG. 13 is a cross-sectional view of the multiple level user and master key system of the present invention taken along line 13—13 of FIG. 12.

The user level rekeying option is best described by reference first to FIGS. 12 and 13, wherein a second level user key U2 is shown positioned in the lock. This second level user key is bitted different than the first level user key U1 in the sixth bit. Specifically, the sixth bit of this second level user key U2 is B6/7C, as opposed to the B6/9C of the first level user key. This second level user key U2 also has a notch 96 recessed into its spine SP. This notch 96 is in transverse alignment with the sixth bit B6/7C and with the sixth service pin 26 and driver pin 36 in the lock 10. In this position, as illustrated in FIGS. 12 and 13, the first user level change wafer 71 is pushed above the shear line 100 by the sixth bit B6/7C of the second level user key U2. Thus, the operating shear line for the sixth position is between the first and second user level wafers 71, 72. However, as described above for the first level user key U1, the fifth bit B5/1C of this second level user key U2 still pushes all of the master wafers 81, 82 above the shear line 100 so that the working shear line in the fifth chamber is under the master level wafers 81, 82 This configuration is consistent with the description above wherein the user keys all work off a shear line under the master level rekeying wafers 81, 82. Further, the first bit B1/3C of this second level user key U2 also raises the permanent master wafer 80 above the shear line 100 as did the first level user key U1 described above. Therefore, as illustrated in FIGS. 12 and 13, the shear line 100 is unbroken, thereby allowing the cylinder 20 to be rotated 180° to the position illustrated in FIGS. 14 and 15.

Figure 14:
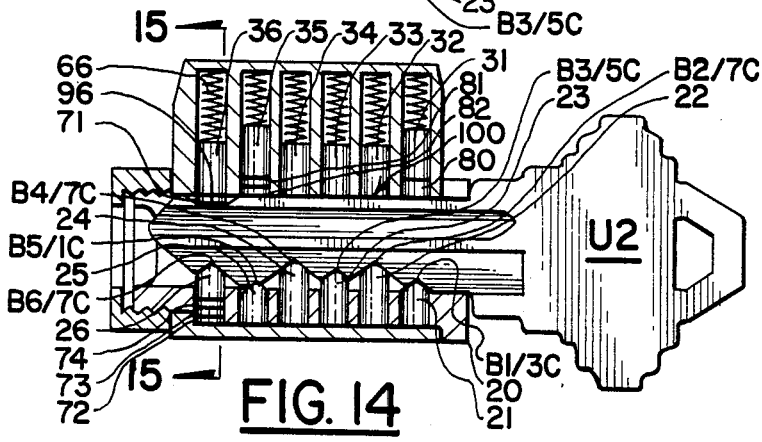
FIG. 14 is a cross-sectional view of the multiple level user and master key system of the present invention with the second level user key positioned therein and rotated 180°.
Figure 15:
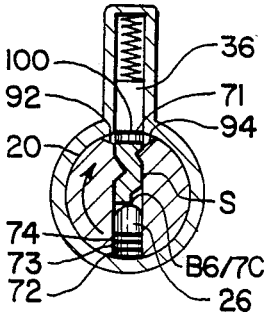
FIG. 15 is a cross-sectional view of the multiple level user and master key system of the present invention taken along line 15—15 of FIG. 14.

When the second level user key U2 is used as described above to rotate the cylinder 20 180° to the positions shown in FIGS. 14 and 15, the first level changing wafer 71 is pushed by spring 66 into the notch 96 in the spine SP of the key U2. This notch 96 is recessed into the spine SP a distance equal to the thickness of the wafer 71, i.e., the thickness of a two cut. Therefore, when the wafer 71 is positioned in the notch 96, the shear line 100 is maintained between the top of the wafer 71 and the bottom of the driver pin 36. Consequently, the key U2 can then be used to again rotate the cylinder 20 180° back to its original position as shown in FIGS. 16 and 17.

Figure 16:
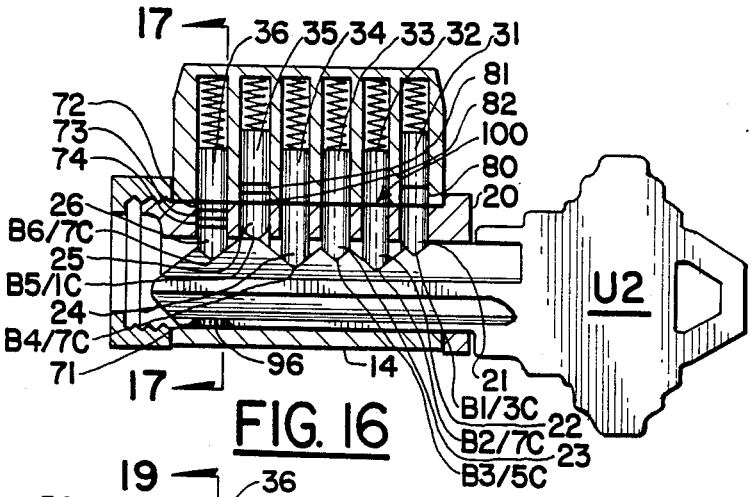
FIG. 16 is a cross-sectional view of the multiple level user and master key system of the present invention with the second level user key positioned therein and illustrating the removal of the first level wafer.
Figure 17:
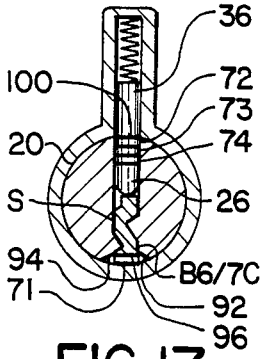
FIG. 17 is a cross-sectional view of the multiple level user and master key system of the present invention taken along line 17—17 of FIG. 16.
Figure 18:
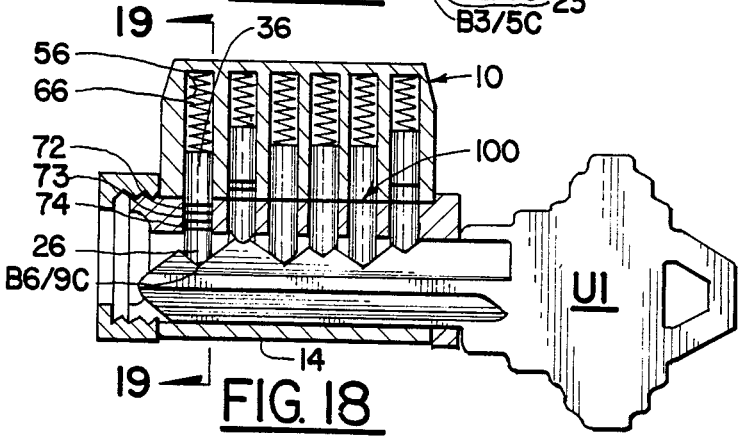
FIG. 18 is a cross-sectional view of the user and master key system of the present invention with the first level user key reinserted therein after the first level wafer has been removed.
Figure 19:
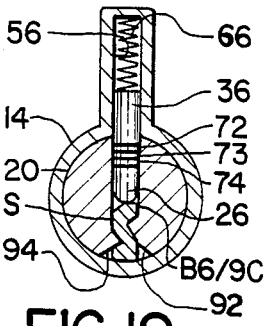
FIG. 19 is a cross-sectional view of the multiple level user and master key system of the present invention taken along line 19—19 of FIG. 18.

When the rotor 20 is rotated back to the original position as shown in FIGS. 16 and 17, the first level user wafer 71 is captured by the notch 96 and carried out of the sixth pin chamber to the bottom of the cylindrical housing 14. Therefore, only three user level wafers 72, 73, 74 remain in the sixth pin chamber. When the second user level key U2 is pulled out of the keyway in this position, the first level user wafer 71 is ejected out of the lock, as more fully described in my previously issued U.S. Pat. Nos. 4,412,437 and 4,440,009. The result is that the sixth bit B6/7C of the second level user key U2 operates off the shear line above the second user level wafer 72 as shown in FIGS. 16 and 17. However, as shown in FIGS. 18 and 19, the sixth bit B6/9C of the first level user key U1 is no longer high enough to provide a shear line across the sixth chamber. Therefore, the spring 66 pushes the sixth driver pin 36 across the shear line 100 into the chamber in the cylinder 20, thereby effectively preventing any rotation of the cylinder 20 in the housing 14. The result of this key change with the second level user key U2, as described above, is that the first level user key U1 is no longer operable in the lock 10.

Figure 20:
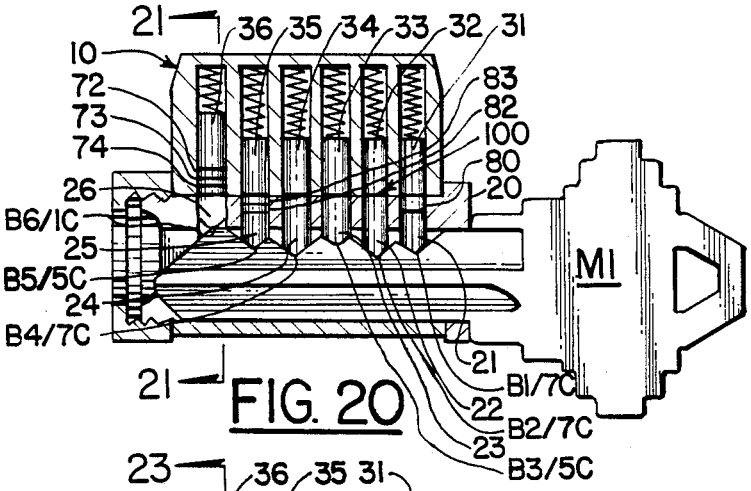
FIG. 20 is a cross-sectional view of the multiple level user and master key system of the present invention with the first level master key inserted therein to illustrate the operation thereof after the first level wafer has been removed.
Figure 21:
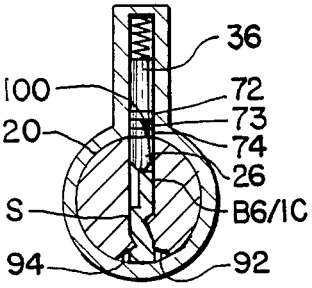
FIG. 21 is a cross-sectional view of the multiple level user and master key system of the present invention taken along line 21—21 of FIG. 20.

However, as illustrated in FIGS. 20 and 21, the above-described user level change accomplished with the second level user key U2 does not affect the operation of the lock 10 with the first level master key M1. On the contrary, the first level master key M1 still is capable of operating the lock 10 in spite of the user level change because the master keys operate off a shear line under the stack of user level change wafers 72, 73, 74 and off a shear line on the top of the master level change wafers 82, 83. More specifically, the sixth bit B6/1C of the master key M1 pushes the user level wafer 72 73, 74 above the shear line 100 and works off the shear line on the top of service pin 26, rather than on the bottom of driver pin 36.

Figure 22:
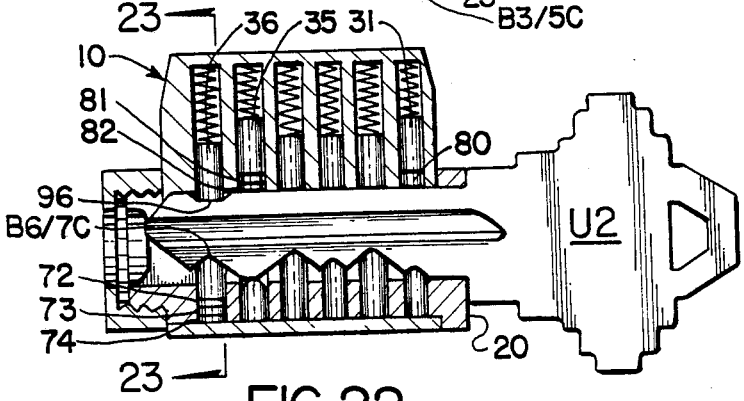
FIG. 22 is a cross-sectional view of the multiple level user and master key system of the present invention taken with the second level user key reinserted therein and rotated 180° after the first level user wafer has been removed.
Figure 23:
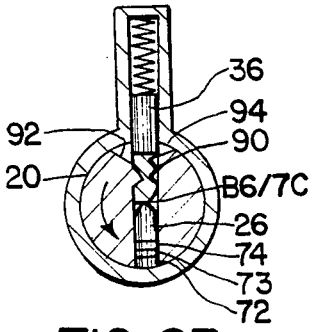
FIG. 23 is a cross-sectional view of the multiple level user and master key system of the present invention taken along line 23—23 of FIG. 22.

Another significant feature of this invention is illustrated in FIGS. 22 through 26. In this illustration, after the second level user key U2 has been used to eject the first user level wafer 71 out of the lock, as described above, this key is reinserted into the lock 10 and rotated 180°. As shown in FIGS. 22 and 23, this position allows the sixth driver pin 36 to drop into the notch 96. In similar prior art rekeyable locks, this occurrence would have caused the second level user key U2 to become jammed or locked in the cylinder 20 by the driver pin 36 so that it could not have been withdrawn and the cylinder 20 could no longer have been turned. Such an occurrence in the prior art rekeyable locks would effectively disable the locks and ruin them for all practical purposes. Therefore, in prior art locks having similar mechanisms with full-sized notches similar to the full-sized notch 96 shown in FIG. 22, it was essential once the second level user key was used to capture and eject the first level wafer from the lock, to be sure that key is never inserted into the lock and rotated 180° again.

Figure 24:
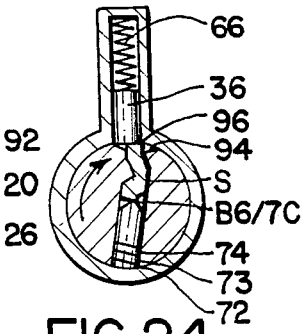
FIG. 24 is a cross-sectional view of the multiple level user and master key system of the present invention similar to that illustrated in FIG. 23, but with the cylinder rotated several degrees to illustrate the upward biasing of the keyway sides on the driver pin to move the driver pin out of the keyway.
Figure 25:
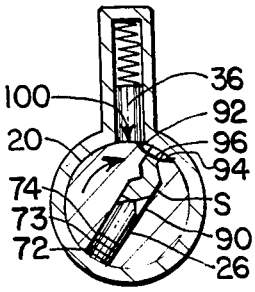
FIG. 25 is a cross-sectional view of the multiple level user and master key system of the present invention similar to FIGS. 23 and 24 but with the cylinder rotated an additional several degrees illustrating the successful removal of the driver pin from the keyway.
Figure 26:
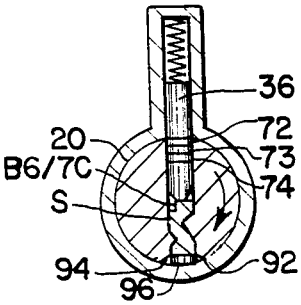
FIG. 26 is a cross-sectional view of the multiple level user and master key system of the present invention similar to FIGS. 23, 24, and 25, but with the cylinder successfully rotated to the position where it can be removed.
Figure 27:
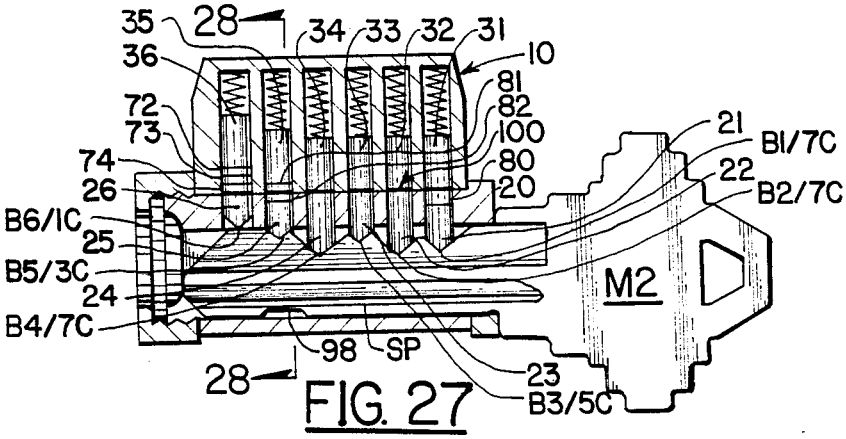
FIG. 27 is a cross-sectional view of the multiple level user and master key system with the second level master key positioned therein.
Figure 28:
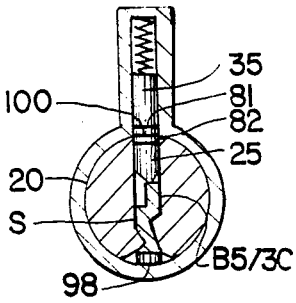
FIG. 28 is a cross-sectional view of the multiple level user and master key system of the present invention taken along line 28—28 of FIG. 27.

In the configuration of this invention, however, this problem is alleviated by the provision of bevelled surfaces 92, 94 along the longitudinal opening of the keyway at the peripheral surface of the cylinder. This feature is also illustrated in the isometric exploded view of the lock cylinder 20 in FIG. 2 with the second level user key U2 positioned therein. With these bevelled edges 92, 94 of the keyway 90, as opposed to the straight sides of prior art locks, the cylinder 20 can be rotated out of this position, even if the driver pin 36 does drop into the notch 96. Such rotation after the driver pin 36 has been dropped into the notch 96 is illustrated in FIGS. 24–26. When the cylinder 20 is rotated as shown in FIG. 24, the bevelled edge 92 cams the driver pin 36 upwardly against the bias of the spring 66 until it is clear of the keyway 90 as shown in FIG. 25. Therefore, the cylinder 20 can be rotated again the remainder of the 180° to its normal position shown in FIG. 26. Once the normal position of FIG. 26 is reached, the key U2 can, of course, be pulled out of the cylinder 20.

The result and effect of this feature is that a user need no longer be concerned about whether the second level key U2 has already been used to remove the first level wafer 71. The user can, with impunity, reinsert the second level user key U2 and rotate it 180° as many times as he desires, for example, to see whether that change level has already been rekeyed. If the notch 96 captures a wafer and ejects it from the lock, then it was not rekeyed at that level before but is with this operation. If it does not capture a wafer and eject it from the lock, then it can be inferred that that level change had been made previously.

This feature also eliminates the requirement to have a different second level user key for continuous use by the user that does not have the notch 96 in the spine SP. In this lock according to this invention, the user can continue to use the second level user key U2 with the notch 96 therein for opening the lock if he so desires withwout fear of the sixth driver pin 36 jamming the user key U2 in the lock.

With a change in the user level keys having been described above, a change in the master level keys is now described by reference to FIGS. 27 through 34. Specifically, in FIGS. 27, and 28, a second level master key M2 is shown inserted into the cylinder 20 of the lock 10. This second level master key M2 has a bitting combination as follows: B1/7C, B2/7C, B3/5C, B4/7C, B5/3C, and B6/1C. Like the first level master key M1, this second level master key M2 has a sixth bit B6/1C that raises all of the user level change wafers 72, 73, 74 above the shear line 100 and operates off the shear line on top of the sixth service pin 26. Also, like the first level master key M1, the second level master kery M2 has a first bit B1/7C that drops the permanent master wafer 80 below the shear line 100 and works off the shear line on top of the permanent master key 80. However, this second level master key M2 has a fifth bit B5/3C that is two cuts higher than the fifth bit B5/5C of the first level master key M1. Therefore, this fifth bit B5/3C pushes the top master change wafer 81 above the shear line 100 and works off the shear line at the top surface of master change wafer 82.

Figure 29:
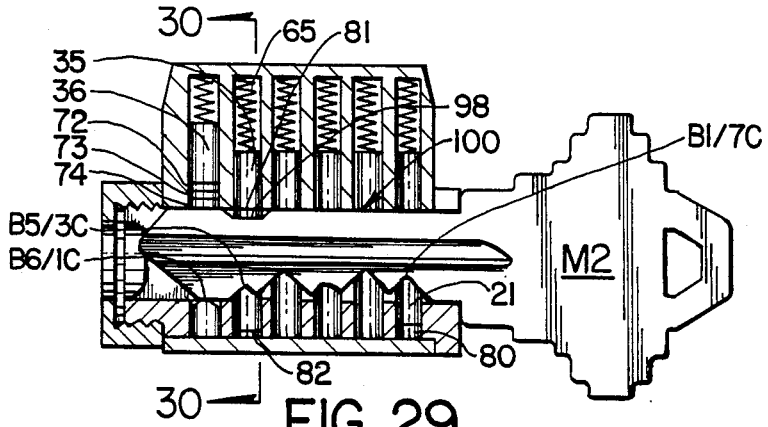
FIG. 29 is a cross-sectional view of the multiple level user and master key system with the second level master key positioned therein and rotated 90°.
Figure 30:
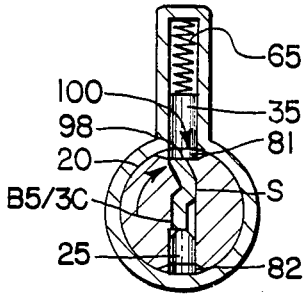
FIG. 30 is a cross-sectional view of the multiple level user and master key system of the present invention taken along line 30—30 of FIG. 29.
Figure 31:
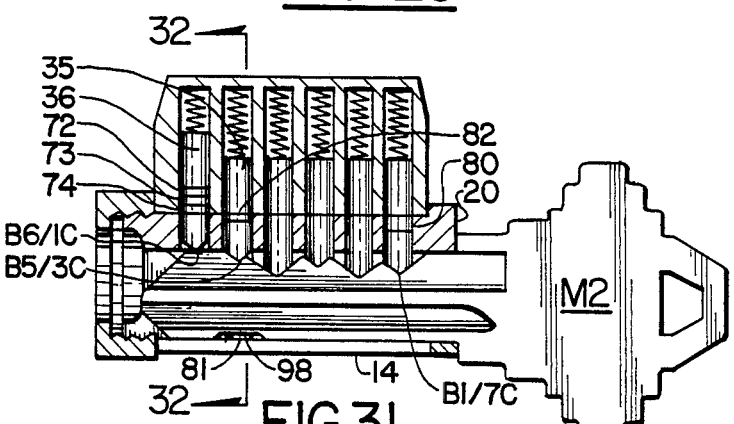
FIG. 31 is a cross-sectional view of the multiple level user and master key system of the present invention with the second level master key positioned therein to remove the first level master wafer therefrom.
Figure 32:
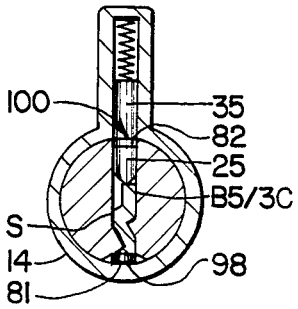
FIG. 32 is a cross-sectional view of the multiple level user and master key system of the present invention taken along line 32—32 of FIG. 31.
Figure 33:
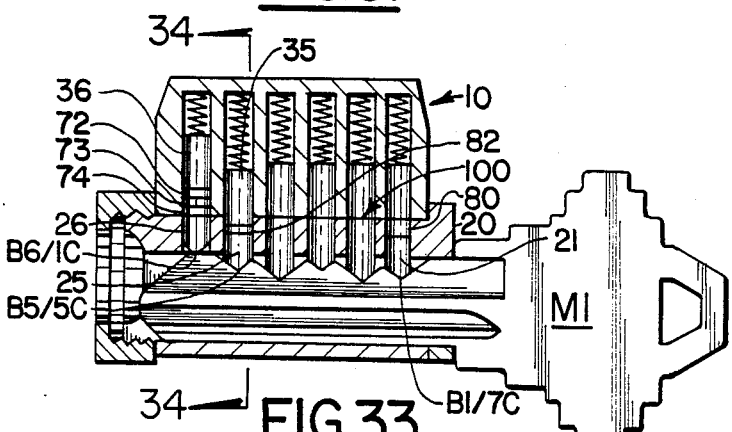
FIG. 33 is a cross-sectional view of the multiple level user and master key system of the present invention showing the first level master key reinserted therein after the first level master wafer has been removed.
Figure 34:
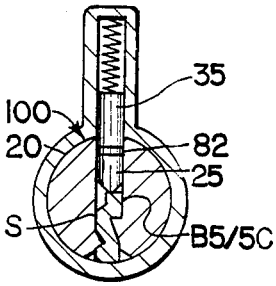
FIG. 34 is a cross-sectional view of the multiple level user and master key system of the present invention taken along line 34—34 of FIG. 33.

This second level master key M2 also has a notch 98 recessed into its spine SP a distance equal to the thickness of the level change wafers 81, 82. This notch 98 is transversely aligned with the fifth bit on the key M2 and with the fifth service pin 25 and fifth driver pin 35 in the lock 10. Therefore, when the cylinder 20 is rotated 180°, as shown in FIGS. 29 and 30, the first level master change wafer 81 is pushed by spring 65 into the notch 98. Since the depth of the notch 98 is equal to the thickness of the wafer 81, a continuous shear line 100 is maintained over the top surface of the wafer 81. Then, the master key M2 and cylinder 20 can be reverse rotated 180° back to the original position as shown in FIGS. 31 and 32, thereby capturing and carrying the wafer 81 to the bottom of the housing 14. In this position, the key can be pulled out of the cylinder 20 to eject the first level master change wafer 81 from the lock 10. With the completion of this operation, the change of the master keying combination to the second level is accomplished. Then, as shown in FIGS. 33 and 34, the fifth bit B5/5C of the first level master key M1 is no longer effective to raise the service pin 25 to a shear line. Consequently, the fifth driver pin 35 interrupts the shear line 100 as shown in FIGS. 33 and 34 and prevents the first level master key M1 from operating the lock 10.

Figure 35:
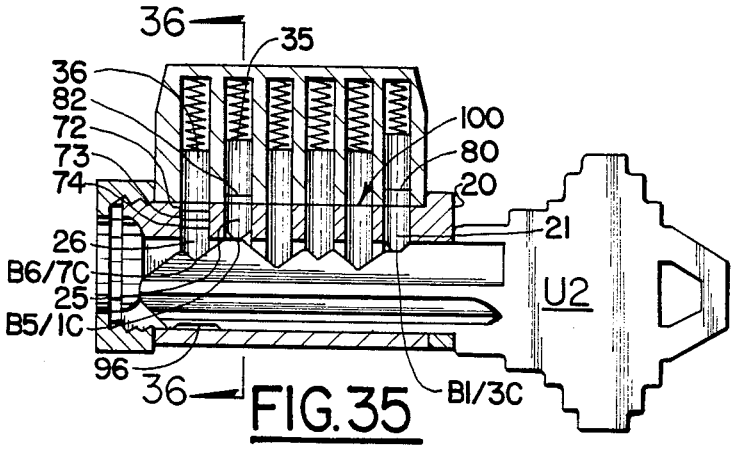
FIG. 35 is a cross-sectional view of the multiple level user and master key system of the present invention with the second level user key reinserted therein and shown operable after the first level master wafer has been removed therefrom.
Figure 36:
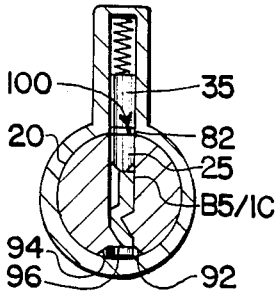
FIG. 36 is a cross-sectional view of the multiple level user and master key system of the present invention taken along line 36—36 of FIG. 35.

However, as illustrated in FIGS. 35 and 36, the change of the master keying to the second level configuration of key M2 does not affect the operation of the lock with the second level user key U2. The user key U2, like the other user keys, works off the shear line at the bottom of driver pin 36 and at the top of service pin 25 so that the ejection of the first level master wafer does not affect the operation of the user keys.

The above description, in conjunction with the figures discussed therein, describes the illustrates the change of a user key level independently of the master key operation, and it illustrates and describes the change of a master level keying configuration without affecting the user key operation. Therefore, a lock 10 constructed according to this invention provides the benefit of multiple level rekeying of user keys as well as multiple levels of rekeying master keys independently of each other.

Figure 37:
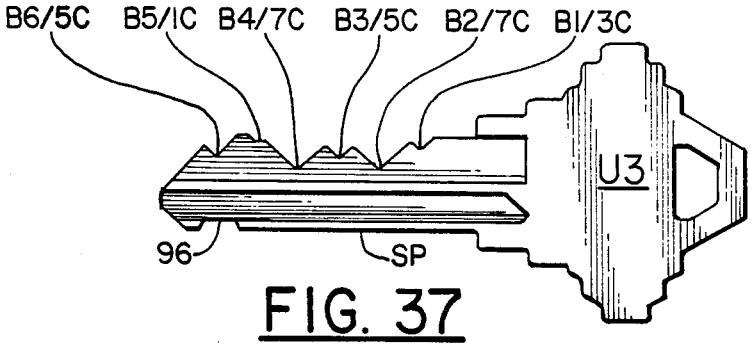
FIG. 37 is a side elevation view of the third level user key.
Figure 38:
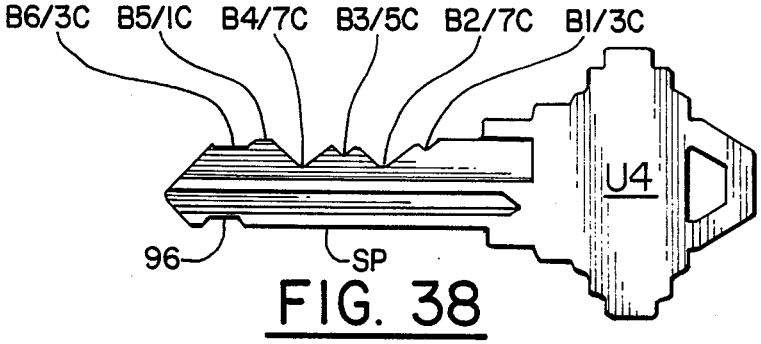
FIG. 38 is a side elevation view of the fourth level user key.

Since the principles, structure, and operation of the lock 10, including first level rekeying for both the user and master keys, are described and illustrated above, it is not considered necessary to describe or illustrate in such detail the similar operation for changing additional user and master key levels by ejecting additional user or master change wafers. Persons skilled in the art should now readily understand how the additional user and master level rekeying of the lock 10 is accomplished. It is believed sufficient to insure an understanding by persons skilled in the art to merely illustrate the third level user key in FIG. 7 and the fourth level user key in FIG. 38. The third level user key U3 in FIG. 37 has the following bitting: B1/3C, B2/7C, B3/5C, B4/7C, B5/1C, and B6/5C. The fourth level user key U4 shown in FIG. 38 has the following bitting: B1/3C, B2/7C, B3/5C, B4/7C, B5/1C, and B6/3C. These third and fourth level user keys are, of course, used to eject the respective third level and fourth level user change wafers 73, 74 from the lock 10 to accomplish the third and fourth level user rekeying.

Figure 39:
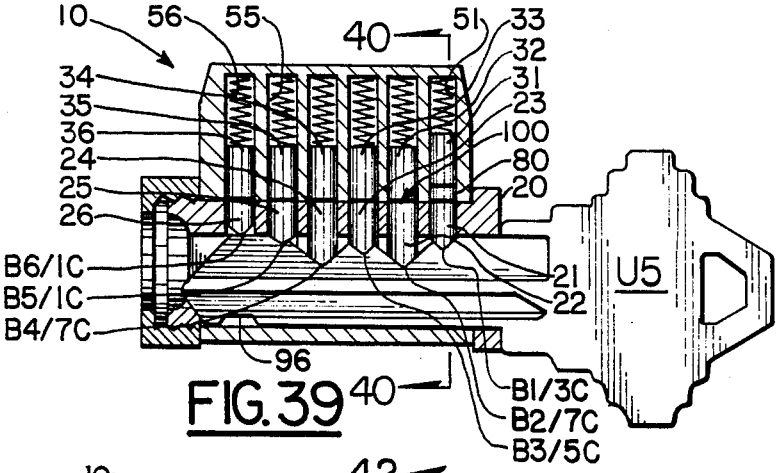
FIG. 39 is a cross-sectional view of the multiple level user and master key system of the present invention with the fifth level user key positioned therein.
Figure 40:
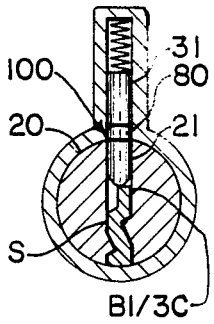
FIG. 40 is a cross-sectional view of the multiple level user and master key system of the present invention taken along line 40—40 of FIG. 39.
Figure 41:
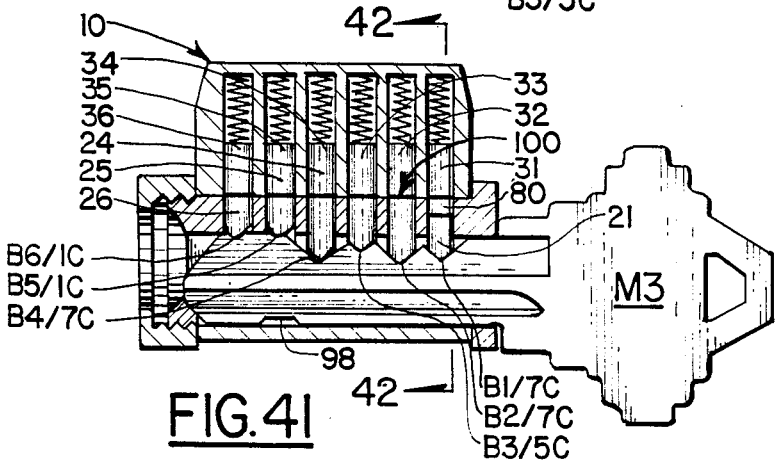
FIG. 41 is a cross-sectional view of the multiple level user and master key system of the present invention with the third level master key positioned therein.
Figure 42:
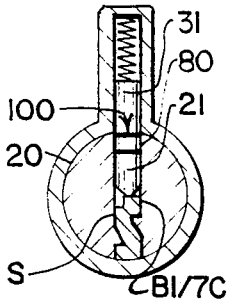
FIG. 42 is a cross-sectional view of the multiple level user and master key system of the present invention taken along line 42—42 of FIG. 41.

It is considered beneficial to illustrate the final level changes of both the user and master keys to illustrate the purpose of the permanent master wafer 80. As shown in FIGS. 39 and 40, the fifth and final level user key U5 is positioned in the lock 10. This fifth level user key U5 has the following bitting: B1/3C, B2/7C, B3/5C, B4/7C, B5/1C, and B6/1C. This fifth level user key U5 with its sixth bit B6/1C raises the service pin 26 to utilize the shear line at the top of service pin 26. In this position, the fourth user level change wafer 74 (not shown in FIG. 39) is raised above the shear line 100, and can be captured in notch 96 and removed from the lock, similar to the procedure described above for the lower user level keys. For the purposes of this illustration in FIGS. 39 and 40, it is understood that the fourth level user change wafer has already been removed from the lock 10 by the fifth level user key U5. Likewise, the illustration in FIGS. 41 and 42 show the third level master key M2 inserted in the lock 10 with the second level master change wafer 82 having already been removed as described above for the lower level changes.

The result of all of the level changes is that the lock 10 is left with only the permanent master wafer 80 in the lock as shown in FIGS. 39 through 42. Further, with the exception of the first bit, the final levels of the user and master keys (illustrated here with user key U5 and master key M3) both have the same bittings. In other words, both the final level user key U5 and the final level master key M3 have the following bitting in common: B2/7C, B3/5C, B4/7C, B5/1C, B6/1C. Consequently, if the first bits in the keys U5 and M3 were also the same, the final level user key U5 would become a master key able to open all of the locks in the system.

In order to eliminate this problem, the permanent master wafer 80 is utilized with a different first bit in the user and master keys. As illustrated in FIGS. 39 through 42, the fifth and final level user key U5 has a first bit B1/3C, which raises the permanent master wafer 80 above the shear line 100 and operates off the shear line at the top of the first service pin 21. The third and final level master key M3, however, has a first bit B1/7C which leaves the permanent master wafer 80 below the shear line 100 and operates off the shear line at the bottom of the first driver pin 31. This feature keeps all the user keys separate from the master keys in a lock system.

Before concluding the description of this embodiment of the invention, it is appropriate to reiterate that the feature illustrated for the second level user key U2 in FIGS. 22 through 26 wherein that key can be reinserted and used as many times as desired without fear of the driver pin dropping into the keyway 90 via the notch 96 to jam the lock is equally applicable to both the remaining higher level user keys U3, U4, and U5, as well as to the higher level master keys M2, M3. Thus, it is always appropriate with this rekeyable lock to continue using the level change key to open the lock as often as desired. It is also acceptable to use any particular level change key to check whether that level change has already been made by trying it in the lock and seeing whether it will eject a wafer.

Figure 3:
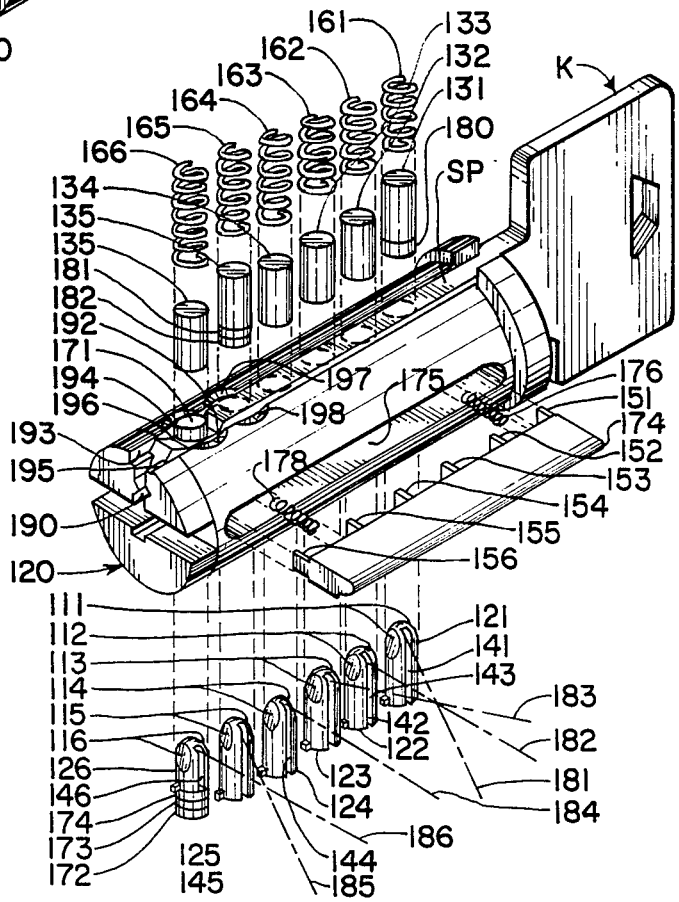
FIG. 3 is an isometric view of the multiple level user and master key system of the present invention in a high security lock embodiment.

Another variation of this feature is illustrated in FIG. 3 for use in a well-known higher security lock. For purposes of explanation and understanding of the necessity of this variation for this type of lock, a brief description of the operation of such a lock is provided for those persons unfamiliar with it. Such a prior art high security lock modified for rekeyable capabilities according to this invention is illustrated in FIG. 3. The service pins 121, 122, 123, 124, 125, and 126 index with the bittings on a key K to raise the driver pins 131, 132, 133, 134, 135, 136 against the bias of springs 161, 162, 163, 164, 165, 166 to establish a consistent shear line at the peripheral surface of the cylinder 120. However, in addition to such normal indexing, the service pins 121, 122, 123, 124, 125, 126 also have in their respective lateral sides longitudinal grooves 141, 142, 143, 144, 145, 146 therein. The cylinder 120 also has an elongated slot 175 in its side into which an elongated bar 174 is slideably inserted. This bar 174 is biased outwardly by two small coil compression springs 176, 178. When the bar 174 extends outwardly beyond the peripheral surface of the cylinder 120, an obstruction in the lock housing (not shown) prevents the cylinder 120 from being rotated, thus preventing the operation of the lock. However, in order for the bar 174 to be fully inserted into the slot 175 so that it does not interfere with rotation of the cylinder 120, the longitudinal grooves 141, 142, 143, 144, 145, 146 must be aligned transversely to the longitudinal axis of the cylinder 120 so that they can receive the short fingers 151, 152, 153, 154, 155, 156 on the inside surface of the bar 174. If any of the service pins 121, 122, 123, 124, 125, 126 is rotated within the cylinder 120 so that its longitudinal groove is not transverse with the longitudinal axis of the cylinder 120, thus cannot receive the respective finger 151, 152, 153, 154, 155, or 156 on the bar 174, then the bar 174 is prevented from being fully inserted into the slotted opening 175 so that the cylinder 120 cannot be turned in the lock housing (not shown).

In order to effect this alignment of the longitudinal slots, each service pin 121, 122, 123, 124, 125, 126 has a slanted surface thereon 111, 112, 113, 114, 115, 116, respectively. The key bitting also has corresponding slanted surfaces thereon which index with the slanted surfaces on the service pins to rotate the service pins within their respective chambers in the cylinder 120 to properly align the longitudinal grooves 141, 142, 143, 144, 145, 146 to receive the fingers 151, 152, 153, 154, 155, 156 on the bar 174. Therefore, in order to open this lock illustrated in FIG. 3, two conditions must be met.

First, the service pins 121, 122, 123, 124, 125, 126 must be raised the appropriate distances to create the shear line under driver pins 131, 132, 133, 134, 135, 136 in alignment with the peripheral surface of the cylinder 120. Second, the service pins 121, 122, 123, 124, 125, 126 must also be rotated so that the respective grooves 141, 142, 143, 144, 145, 146 can receive therein the fingers 151, 152, 153, 154, 155, 156 on the inside of the bar 174.

This type of lock, a shown in FIG. 3, can be equipped with user and master level change wafers according to this invention as described above. For example, as shown in FIG. 3, four user level change wafers 171, 172, 173, 174 are positioned between the service pin 126 and the driver pin 136. Also similar to the invention described above, two master level change wafers 181, 182 are positioned between the fifth service pin 125 and the fifth driver pin 135. Finally, as described for this invention above, a permanent master wafer 180 is positioned between the service pin 121 and the driver pin 131. Therefore, with these multiple level change wafers and the permanent master wafer in this high security lock, it can be used as described for the preferred embodiment above, to rekey multiple user levels and mutiple master levels independently of each other.

Figure 2:
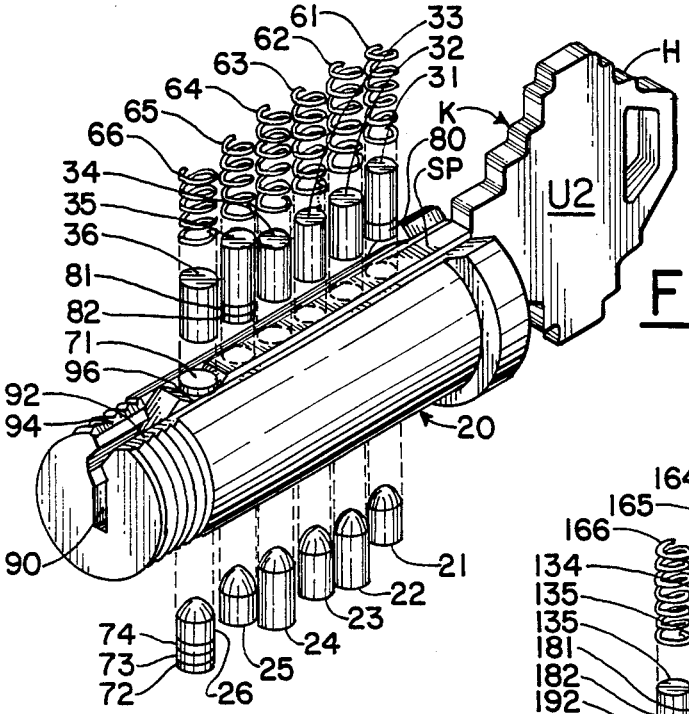
FIG. 2 is an isometric view showing the cylinder, tumbler pin, and key components of the multiple level user and master key system of the present invention.

It has been found, however, that in this type of high security lock, the level change wafers are not sufficiently confined by the bevelled edges 92, 94 shown in FIG. 2 The side bar hole 175 tends to dislocate the wafer pins in such a keyway channel with bevelled edges 92, 94. Such dislocation can jam the lock. Therefore, the modification illustrated in FIG. 3 includes tapered pockets having opposite sides 192, 194 in the straight edges 193, 195 of the keyway 190 under the sixth driver pin 136. A similar round, tapered pocket is provided under the fifth driver pin 135 having rounded, tapered opposite sides 197, 198 in the straight edges 193, 195 of the keyway 190. These pockets more effectively capture and retain a wafer, such as wafer 171, in the notch 196 from moving longitudinally in the keyway 190 during rotation of the service pin 126. Consequently, this bevelled edge pocket configuration is more reliable than the elongated bevelled edge configuration shown in FIG. 2, especially for locks in which the service pins are rotatable. Of course, this round, tapered pocket arrangement can also be used in the preferred embodiment of FIG. 2 described above instead of the elongated tapered edges 92, 94.

As mentioned above, additional user and master levels can be made by adding additional level change wafers to additional chambers in the lock. Such additional lock configurations would, of course, continue to allow level changes as well as master changes independently of each other if the principles described above for this invention are followed. However, while such multiple level rekeying capability as described above have many beneficial attributes, they can also cause a significant decrease in the security of the lock. For every additional rekeying level provided, an additional possible shear line is also provided. Such multiple shear lines, of course, render such a lock much more susceptible to picking or unauthorized opening. Therefore, this invention includes additional embodiments and variations that provide increased security and resistance to picking or unauthorized opening, which are described in detail below.

As background information, the most common method used by lock pickers in picking locks is to insert a tool into the keyway of the lock and hold a rotational bias on the cylinder while manipulating the pins in the keyway with a second tool. When such rotational bias is maintained on the cylinder, an adept lock picker can "feel" ever so slight a movement in the cylinder when a shear line has been found. Then, once such a shear line is found, the rotational bias maintained on the cylinder is also effective to hold the aligned pins in the shear line position while the lock picker moves on to the next pin to find the next shear line. Therefore, elimination of the lock picker's ability to "feel" the shear lines as the pins are manipulated increases the security of the lock.

Figure 43:
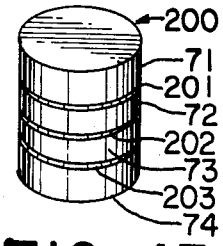
FIG. 43 is an isometric view of a stack of mulitple level removable wafers for use in the multiple level user and master key system of the present invention with the wafers in the stack adhered together in a solid column.
Figure 44:
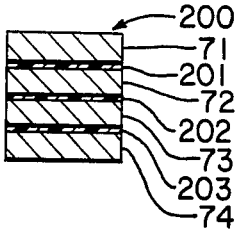
FIG. 44 is a cross-sectional view in elevation of the adhered multiple level wafer stack illustrated in FIG. 43.
Figure 45:
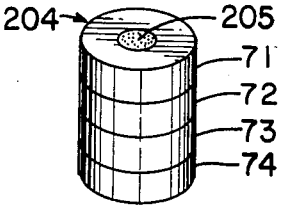
FIG. 45 is an alternate embodiment of the multiple level wafer stack for use in the present invention with a solid, frangible graphite core therethrough.
Figure 46:
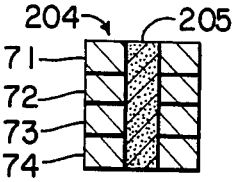
FIG. 46 is a cross-sectional view in elevation of the multiple level wafer stack illustrated in FIG. 45.

The illustrations in FIGS. 43 and 44 show one method of eliminating a lock picker's ability to feel some of the shear lines created by the addition of multiple level changing wafers into the lock as described above. As shown in FIGS. 43, 44 the four user level change wafers 71, 72, 73, 74 are glued together in a stack with a frangible glue material. The glue lines 201, 202, 203 retain the four wafers 71, 72, 73, 74 in a rigid column that has the practical effect of one elongated pin with only a shear line on the top of pin 71 and another on the bottom of pin 74, rather than the five actual shear lines contained in the stack. Therefore, when this stack of four wafers is positioned in the lock, a lock picker with his tools cannot feel the intermediate shear lines at the glue lines 201, 202, 203. However, when the change level key is inserted and operated in the lock, the glue line that is aligned with the shear line of the lock can be broken. Once the glue line is broken, the water can be removed from the lock in the manner described above.

The variation of this rigid stack of wafers 204 shown in FIGS. 45 through 48 essentially have the same functional effect as the glued wafer stack 204 shown in FIGS. 43 and 44. However, the embodiment 204 shown in FIGS. 45 and 46, the individual wafers 71, 72, 73, 74 have hollow cores through which a solid frangible core of graphite 205 is inserted. This solid graphite core 205 retains the individual wafers 71, 72, 73, 74 in the stack. Again, a lock picker cannot feel the intermediate shear lines between these wafers because the wafers are prevented by the graphite core 205 from moving in relation to each other. However, sufficient pressure on a level change key can break the graphite core 205 at the appropriate shear line when the level is being changed according to this invention as described above. The broken graphite core 205 also has the additional advantage of lubricating the lock internally whenever the keying level is changed.

Figure 47:
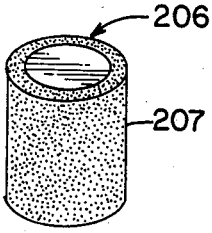
FIG. 47 is an isometric view of another embodiment of a multiple level wafer stack for use in the multiple level user and master key system of the present invention wherein the wafer stack is positioned in a solid, frangible graphite sleeve.
Figure 48:
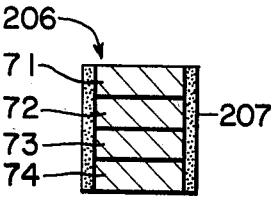
FIG. 48 is a cross-sectional view in elevation of the multiple level wafer stack shown in FIG. 47.

The wafer stack 206 illustrated in FIGS. 47 and 48 utilizes a sleeve of solid, frangible material 207 that holds the stack of wafers 71, 72, 73, 74 together. This sleeve 207 is also preferably a graphite material.

As is clearly illustrated in the cross-section of FIG. 48, in this embodiment 206 the individual level wafers 71, 72, 73, 74 are stacked inside the cylindrical sleeve 207. Therefore, until individual wafers are removed for changing the keying combination levels, the shear lines between the wafers 71, 72, 73, 74 cannot be felt by a person picking the lock. However, when an individual wafer, such as the top wafer 71, is raised above the shear line for removal to change the keying level, as illustrated in FIGS. 12 and 13, the shear line between wafers 71 and 72 is aligned with the shear line 100 of the lock. Then, when the cylinder is turned with the key, the frangible sleeve 207 will break and shatter at the shear line between wafers 71 and 72 to allow the top wafer 71 to be removed from the stack as described above. Again, as with the embodiment 204 shown in FIGS. 45 and 46, the graphite material will lubricate and enhance the operation of the lock.

This wafer stack embodiment 206 illustrated in FIGS. 47 and 48 utilizes wafers that are smaller in diameter than the pin chambers in order to provide sufficient space for the sleeve 207. Consequently, this embodiment is particularly appropriate for use in rekeyable lock embodiments that utilize smaller diameter pins, such as the alternate embodiment of this invention shown in FIGS. 88 through 99 and described below, as well as in rekeyable lock apparatus such as that described in my previously issued U.S. Pat. No. 4,412,437. When the top pin is sheared from the remainder of the stack in this embodiment, the graphite sleeve 207 around the pin to be removed completely shatters, leaving the effective diameter of the actual pin to function as described in those embodiments for selective removal thereof.

A higher security lock embodiment of the present invention is shown in FIGS. 49 through 58. In this high security lock embodiment, referring first to FIG. 49, three of the service pins 212, 213, 214 in the cylinder 220 that are not being utilized for rekeying or master levels have transverse slots or openings 292, 293, 294, respectively, in their upper ends. The driver pins 232, 233, 234 in the corresponding second, third, and fourth positions have transverse narrow protrusions or cotters 302, 303, 304 protruding from the respective bottoms of the driver pins 232, 233, 234. These protrusions or cotters 302, 303, 304 are sized and shaped to be received into and engage the respective slots or openings 292, 293, 294 in the tops of the service pins 212, 213, 214.

The remaining driver pins 231, 235, 236 and corresponding service pins 211, 215 and the service pin in the sixth position (not shown) are utilized in this embodiment much the same as the corresponding pins in the first, fifth, and sixth positions described above in the preferred embodiment illustrated in FIGS. 4 through 42. In other words, these pin positions include the rekeyable user and master level features described above. For example, the permanent master wafer 280 in position number one corresponds to the permanent master level wafer 80 illustrated in the preferred embodiment above. Likewise, the master level change wafers 281, 282 in FIG. 49 correspond to the similar master level change wafers 81, 82 in the preferred embodiment illustrated above. The user level change wafer 271 in the sixth position in FIG. 49 corresponds to the similar user level change wafer 71 described in the preferred embodiment above.

Figure 49:
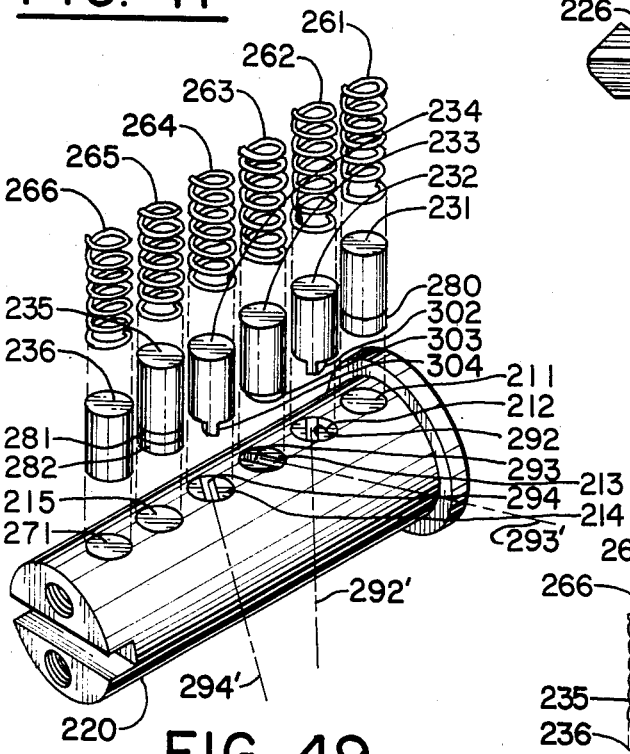
FIG. 49 is an isometric view of an alternate embodiment high security multiple user and master key system according to the present invention.

The remaining user level change wafers in FIG. 49 are positioned in the sixth pin chamber in the cylinder 220 under the wafer 271 so that they cannot be seen in this illustration. However, even though the additional user level change wafers are not shown in FIG. 49, it is understood that they can be utilized there as in the preferred embodiment described above. Likewise, the driver springs 261, 262, 263, 264, 265, 266 bias the respective driver pins 231, 232, 233, 234, 235, 236 downwardly toward the cylinder 220, as described in the preferred embodiment above.

It should be noted in referring to FIG. 49 that the orientation of the slots 292, 293, 294 in the service pins 212, 213, 214 and the corresponding cotters 202, 203, 204 in the respective driver pins 232, 233, 234 are "scrambled" or oriented at different angles with respect to the longitudinal axis of the cylinder 220. These components assume these scrambled positions when the key is removed from the keyway of the cylinder 220. The purpose for this scrambling of the orientations of the service pins 212, 213, 214 is to prevent the cylinder 220 from being turned in the lock even when all of the shear lines in the pins are aligned. In other words, when any of the cotters 302, 303, 304 and the corresponding slot 292, 293, or 294 of any of the pins is not positioned transverse to the longitudinal axis of the cylinder 220, the cylinder 220 is prevented from rotating in the lock body.

Figure 50:
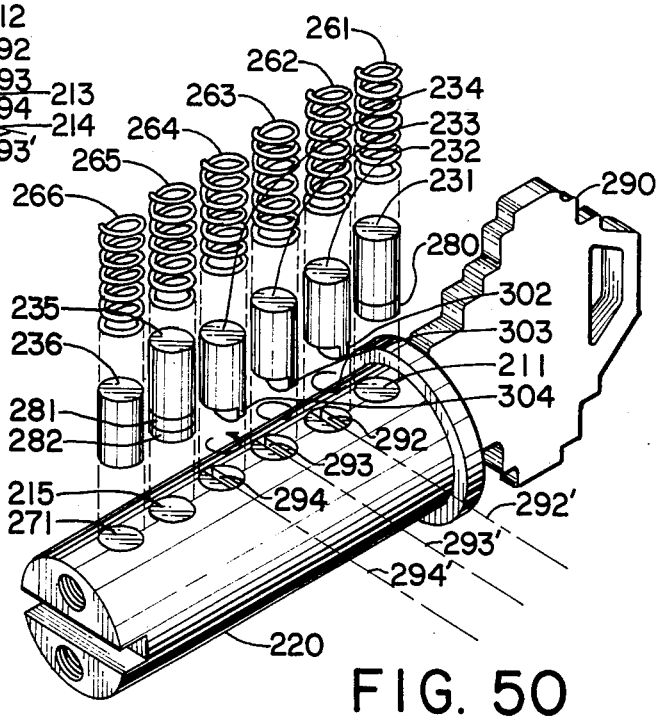
FIG. 50 is an isometric view of the high security embodiment multiple level user and master key system of the present invention with an appropriately configured and cut key inserted therein for opening the lock.

Therefore, in order for the lock to be opened, it is not only necessary to align the shear lines of the pins with the top surface of the cylinder 220, it is also necessary to reorient the respective cotters 302, 303, 304 and corresponding slots 292, 293, 294 transverse to the longitudinal axis of the cylinder 220, as illustrated in FIG. 50. In this position illustrated in FIG. 50, with the driver and service pins in the second, third, and fourth positions are rotated as illustrated by the arrows to "unscramble" the orientations so that the cotters 302, 303, 304 and corresponding slots 292, 293, 294 are transverse to the longitudinal axis of the cylinder 220 as indicated by center lines 292', 293', 294'. The cylinder 220 can then be turned by the key 290 to open the lock. Of course, the shear lines of all of the pins must also be aligned with the upper surface of the cylinder 220 in the conventional manner to open the lock.

Figure 52:
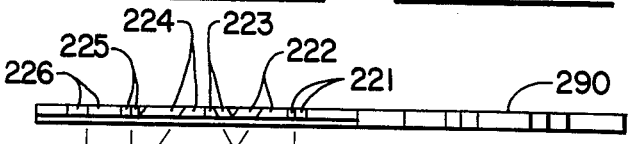
FIG. 52 is a top plan view of the key shown in FIG. 51.
Figure 51:
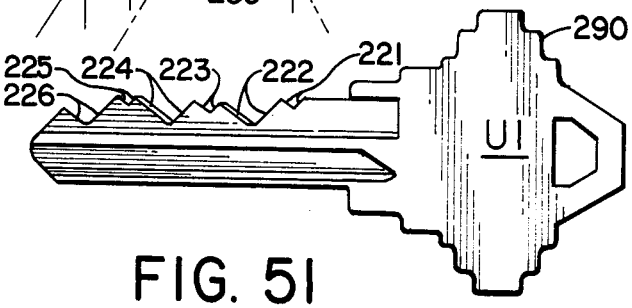
FIG. 51 is a side elevation view of an appropriately cut and configured key as shown in FIG. 50.

The unscrambling or rotation of the pins in the second, third, and fourth positions, as shown in FIG. 50, is accomplished by insertion of a specially configured key 290 having bevelled surfaces in the bittings for the second, third, and fourth positions, as illustrated in FIGS. 51 and 52. For example, the bitting for the second position of the key 290 has surfaces 222 that are bevelled or slanted at an acute angle to the longitudinal axis of the key, as illustrated by the center line 229 in FIG. 52. Similarly, the surfaces 223, 224 of the respective third and fourth bittings of the key 290 are also oriented at an acute angle to the longitudinal axis of the key 290, as illustrated by the center lines 239, 249, respectively. The remaining bittings for the first, fifth, and sixth positions of this key 290 have respective surfaces 221, 225, 226 that are transverse to the longitudinal axis of the key 290 in the ordinary manner, as shown by the respective center lines 219, 259, 269 in FIG. 52.

Figure 54:
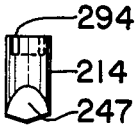
FIG. 54 is a front elevation view of the service pin shown in FIG. 53.

The service pins 212, 213, 214 in the second, third, and fourth positions have essentially flat slanted surfaces or faces to mate with the bevelled surfaces 222, 223, 224 in the key bitting. For example, the pin 214 for the fourth position is illustrated in FIGS. 53 and 54 having slanted or bevelled bottom faces 247, 248 for mating with the bevelled or slanted surfaces 224 of the key 290. The slots 292, 293, 294 in the tops of the respective service pins 212, 213, 214 are oriented such that when the bevelled faces of those pins are mated with the respective bevelled surfaces in the bittings of the key 290, the slots 292, 293, 294 are positioned transverse to the longitudinal axis of the cylinder 220, as shown in FIG. 50. Therefore, when the angle orientations of these slots 292, 293, 294 on the service pins 212, 213, 214 correspond appropriately to the angled or slanted surfaces 222, 223, 224 of the second, third, and fourth bittings of the key 290, then the slots 292, 293, 294 will be properly oriented transverse to the longitudinal axis of the cylinder 220 when the key 290 is inserted into the keyway in the cylinder 220. Of course, when the lock is assembled, the cotters 302, 303, 304 on the driver pins 232, 233, 234 are inserted into and engaged with the slots 292, 293, 294 in the service pins 212, 213, 214. Consequently, proper orientation of the service pins 212, 213, 214 will also result in the cotters 302, 303, 304 being oriented transverse to the longitudinal axis of the cylinder 220 as well.

Figure 55:
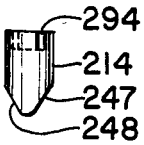
FIG. 55 is a cross-sectional view in side elevation of the high security embodiment multiple level user and master key system of FIGS. 49 and 50.

The operation of this high security lock assuming insertion of a properly cut and bitted key 290 in the cylinder 220 is illustrated in FIGS. 55 through 58. Referring first to FIG. 55, a first level user key 290 is shown in the lock 210 of this embodiment. In this illustration, this user key 290 has its first bitting cut to position the permanent master wafer 280 above the shear line 100, its fifth bit cut to position both the master level change wafers 281, 282 above the shear line 100, and the sixth bit cut to position the user level change wafers 271, 272, 273, 274 below the shear line 100. Likewise, the cuts on the second, third, and fourth bittings are such that the shear lines between the respective driver pins and service pins in those positions are also at the shear line 100. Additionally, the slanted surfaces on the bittings of the second, third, and fourth positions of this key 290 are as shown in FIGS. 51 and 52 to orient the cotters 302, 303, 304 and corresponding slots 292, 293, 294 transverse to the longitudinal axis of the cylinder 220, all as described above.

FIG. 56 is an illustration of the lock opening at the fourth position pins, but it is representative of the lock opening at the second and third position pins as well. As described above, the key 290 is cut in this fourth position bit to position the shear line between the driver pin 234 and the service pin 214 at the shear line 100 on the peripheral surface of the cylinder 220. In addition, the rounded cotter 304 on the bottom of the driver pin 234 is positioned in the slot 294 in the top of the service pin 214. Then, when the key 290 in cylinder 220 begins to rotate in the direction indicated by the arrow illustrated in FIG. 57, the rounded surface of the cotter 304 is cammed upwardly by the edge 244 of the cylinder 220 adjacent the slot 294. As the cylinder 220 continues to rotate, as shown in FIG. 58, the cotter 304 is cammed and lifted completely out of the slot 294 so that it rides on the peripheral surface of the cylinder 220 as the cylinder 220 is turned to open the lock. In reverse, when the cylinder 220 is rotated in the opposite direction, the cotter 304 on the bottom of driver pin 234 will fall back into the slot 294 in service poin 214 when the driver pin 234 and service pin 214 are again axially aligned with each other.

It is important to understand that if the cotter 304 in corresponding slot 294 had not been oriented by the key 290 to a position transverse with the longitudinal axis of the cylinder 220, as described above, it would have been impossible for the cylinder 220 to have been rotated. The cotter 304, which is positioned across the shear line 100, would have prevented such rotation. It is only when the cotter 304 and the slot 294 are oriented transverse to the longitudinal axis of the cylinder 220 that the rounded surface of the cotter 304 will be effective to cam the driver pin 234 upwardly over the edge 244 of the cylinder 220 to allow the cylinder 220 to be rotated.

From the above description, it can be appreciated that this configuration provides a much higher degree of security than the preferred embodiment described above and illustrated in FIGS. 4 through 42. One of the significant reasons for such higher security, of course, is that the service pins 212, 213, 214 not only have to be lifted to the appropriate height to align the shear lines with the surface of the cylinder 220, but they all must also be rotated the proper degrees to orient the slots 292, 293, 294 transverse to the longitudinal axis of the cylinder 220. Thus, it is very unlikely that an unauthorized person would have a key configured to accomplish all of these functions.

Further, it would be very difficult for an unauthorized person to pick this lock. He would not only have to get the shear lines properly aligned for all six pins, he would also have to get the second, third, and fourth pins 212, 213, 214 all rotated to the proper orientation with respect to the longitudinal axis of the cylinder 220. Such a task would be extremely difficult, if not practically impossible.

It is also significant to note that this lock configuration provides an additional security advantage beyond what can be gleaned from the description above. Specifically, as described above, it is a common practice for most lock pickers to insert a tool into the keyway of the cylinder and apply a rotational torque to the cylinder. Then, while holding that rotational torque, they use a second tool to work on individual pins until a shear line is found. An experienced lock picker can usually tell when the shear line is found on a pin by "feeling" a very slight movement in the cylinder while he is holding the rotational torque thereon when the shear line is aligned. Then, by continuing to hold the rotational torque on the cylinder, those pins will be held in the proper shear line alignment while the picker moves on to the next pin to find the shear line alignment thereof. In this manner, an experienced lock picker can, without too much difficulty, progress usually from the sixth pin to the first pin of a lock sequentially finding the shear lines for each pin position, and thereby attain the opening of the lock.

In the present high security embodiment 210 of this invention, however, the lock picker cannot feel any indication in the lock for aligning the second, third, and fourth pins in their proper rotations. The cylinder will not rotate until all of the slots 292, 293, 294 are oriented transverse to the longitudinal axis of the cylinder. However, the lock picker has no way of knowing when such orientation of any one of those keys is reached. Further, he cannot feel when a shear line of any of these pins is reached because the cotters on the driver pins still extend across the shear lines into the cylinder when the shear lines are aligned. The downward pressure of the springs on these three driver pins also inhibits any feeling of shear lines until all three pins are angularly aligned at the same time when they can be cammed together out of the cylinder. Therefore, the lock picker cannot simply manipulate one pin until he finds the proper orientation and shear line and then sequentially move on to the next pins as he can in picking conventional locks. If he cannot get all three pins 292, 293, 294 properly aligned at precisely the same time, for which there is no indication by "feel" in the mechanism of the lock, the lock will not open. Therefore, this high security lock embodiment 210 deprives the lock picker of his most significant aid in picking a lock, that being his "feel" of achieving proper pin alignments in the lock.

As briefly described above, the additional shear lines provided by the numerous user level change wafers 271, 272, 273, 274, as well as the additional master level change wafers 281, 282, the security of such multiple level user and master lock systems is compromised to some extent. However, with the addition of the unique configuration of the second, third, and fourth pin positions with the engaging cotters 302, 303, 304, and the corresponding slots 292, 293, 294, the security of such a multiple level rekeyable user and master key system is significantly enhanced. Additionally, when such a lock is also provided with the stacked change wafers illustrated in FIGS. 43 through 48 above, the security of such a lock is enhanced even more.

FIGS. 59 and 60 illustrate the high security features of the lock embodiment 210 described above, but without the multiple level rekeyable user and master key system of this invention. If maximum security, rather than rekeying ability, is the primary goal of a lock installation, then the features of this embodiment can be used in all six pin positions, as shown in FIGS. 59 and 60. In this configuration, all six service pins 211, 212, 213, 214, 215, 216 have respective slots 291, 292, 293, 294, 295, 296 in the tops thereof, all of which can be scrambled as indicated by the center lines 291', 292', 293', 294', 295', 296'. When so scrambled, the cotters 301, 302, 303, 304, 305, 306 on the bottoms of the respective driver pins 231, 232, 233, 234, 235, 236 all intersect the shear lines of the lock and prohibit the cylinder 220 from being turned, even when the shear lines of all six pins are properly aligned. Therefore, in order to open this lock, all six service and driver pins must not only have proper shear line alignment with the surface of the cylinder 220, but they must all also be rotated as indicated by the arrows in FIG. 60 to get all of the cotters 301, 302, 303, 304, 305, 306 and corresponding slots 291, 292, 293, 294, 295, 296 are oriented transverse to the longitudinal axis of the cylinder 220 as indicated by the center lines 291', 292', 293', 294', 295', 296'. As explained above, it would be extremely difficult and highly unlikely for a lock picker to be able to achieve all of these physical alignments without the benefit of the "feel" of aligning shear lines on which a lock picker normally relies in picking conventional locks.

The key 299 shown in FIGS. 61 and 62 is illustrative of a key embodiment configured for use in the lock cylinder shown in FIGS. 59 and 60. In this key embodiment 299, all six bitting positions have respective slanted surfaces 221, 222, 223, 224, 225, 226, as illustrated by the center lines 219, 229, 239, 249, 259, 269. These slanted surfaces in the key bitting correspond to appropriately configured service pins 211, 212, 213, 214, 215, 216, as described above, for orienting the slots 291, 292, 293, 294, 295, 296 transverse to the longitudinal axis of the cylinder 220.

A variation 310 of the high security lock embodiment 210 of FIGS. 49 through 58 is shown in FIGS. 63 through 67. Similar to the lock embodiment 210 described above, this variation 310 in FIG. 63 includes a cylinder 320 with service pins positioned in key chambers therein. The service pins 311, 312, 313, 314, 315, are shown, while the sixth service pin is positioned in the cylinder 320 under the level change wafer 371, thus not seen in this FIG. 63. The driver pins 331, 332, 333, 334, 335, 336 are positioned above the service pins and are biased downwardly by respective springs 361, 362, 363, 364, 365, 366. A permanent master wafer 380, as well as master level change wafers 381, 382 are also illustrated. These master and user wafers function in this lock as they do in those embodiments described above; therefore, it is not necessary to describe them again in relation to this embodiment.

Figure 63:
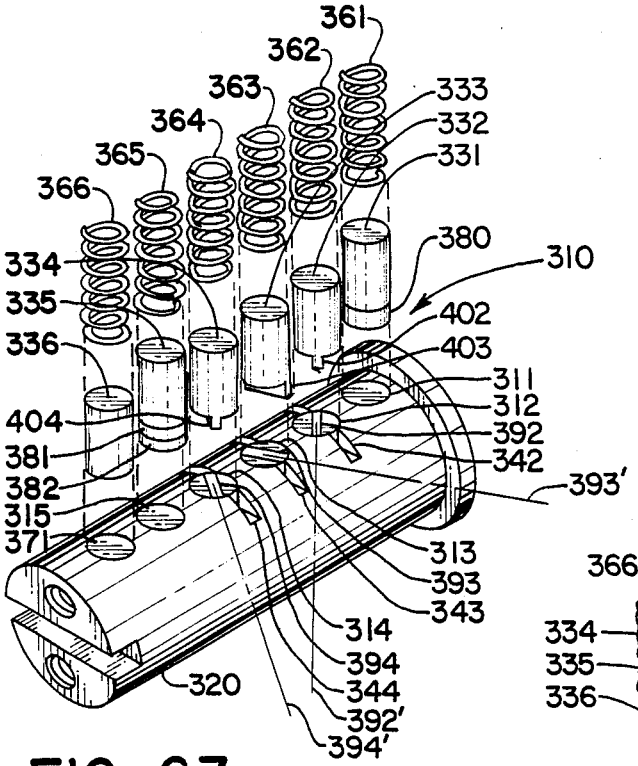
FIG. 63 is an isometric view of the essential components of another embodiment of the high security lock system similar to that shown in FIG. 59, but with a different driver pin camming structure.
Figure 64:
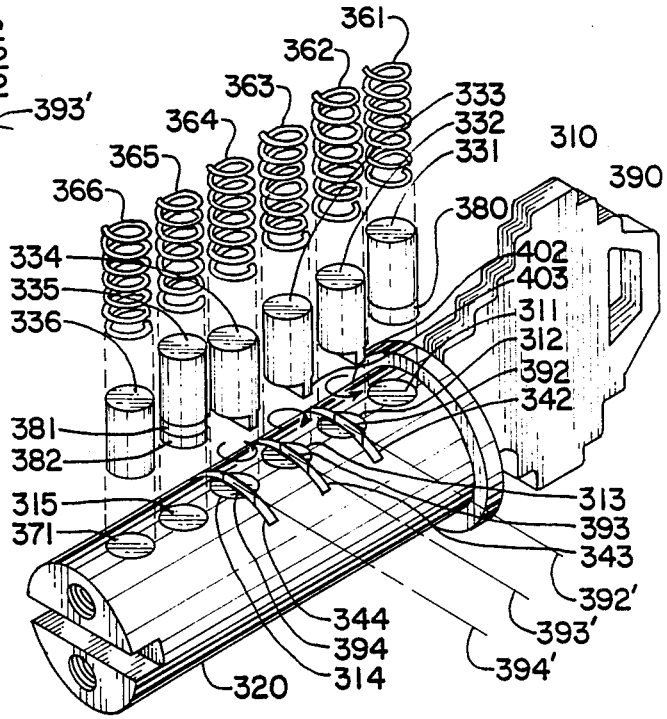
FIG. 64 is an isometric view of the alternate embodiment lock shown in FIG. 63, but with a key inserted in the cylinder to unscramble the orientation of the high security pins therein.

The significant difference between this lock configuration 310 in FIGS. 63 and 64 and the high security embodiment 210 described above is that the cotters 402, 403, 404 on the bottom of driver pins 332, 333, 334 are not rounded on the bottom surfaces. Instead, they are rectangular in shape with square corners on their bottom edges. Therefore, in order to cam the driver pins 332, 333, 334 upwardly as the cylinder 320 is rotated to open the lock 310, transverse slots 342, 343, 344 are provided in the surface of the cylinder 320 adjacent the pins 312, 313, 314. These slots 342, 343, 344 are recessed into the surface of the cylinder 320 a depth approximately equal to the height of the cotters 302, 303, 304 and approximately equal to the depth of the slots 392, 393, 394 in the respective pins 312, 313, 314.

When the orientation of the slots 392, 393, 394 in respective pins 312, 313, 314 are scrambled as shown in FIG. 63 and illustrated by the center lines 392', 393', 394', the cotters 402, 403, 404 interrupt the shear lines and prevent the lock from being opened. In order to open the lock, an appropriate key 390 has to be inserted into the cylinder 320 with appropriate slanted surfaces in the bittings thereon to orient the service pins 312, 313, 314 so that the respective slots 392, 393, 394 are rotated to positions transverse to the longitudinal axis of the cylinder 320. Such transverse orientation places these slots 392, 393, 394 in alignment with the slots 342, 343, 344 in the surface of cylinder 320, as illustrated in FIG. 64 by the center lines 392', 393', 394'.

Figure 65:
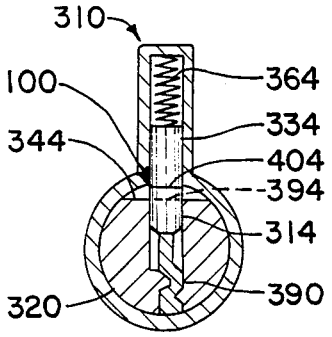
FIG. 65 is a cross-sectional view of the fourth pin position of the lock shown in FIG. 64 with the key inserted therein to position the pins for opening the lock.

FIG. 65 is a cross-sectional view of the lock 310 illustrating the structure and function of the fourth pin position. While this illustration, as well as those of FIGS. 66 and 67, are directed to the fourth pin position of the lock 310, they are representative of the second and third pin positions of the lock as well.

In FIG. 65, the fourth pin position is shown with the service pin 314 oriented so that the slot 394 in the top thereof is positioned transverse to the longitudinal axis of the cylinder 320 to correspond with that same position shown in FIG. 64. The key 390 has the top of pin 314 aligned with the shear line 100 in a conventional manner, and the rectangular cotter 404 on the bottom of driver pin 334 is positioned in the slot 394.

Figure 66:
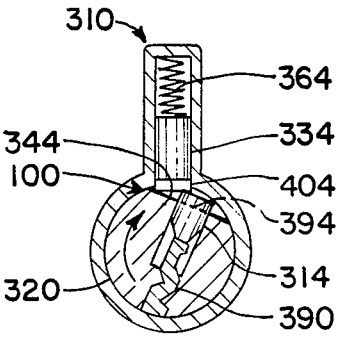
FIG. 66 is a cross-sectional view similar to FIG. 65, but with the cylinder rotated several degrees to illustrate the upward camming of the cylinder on the driver pin.
Figure 67:
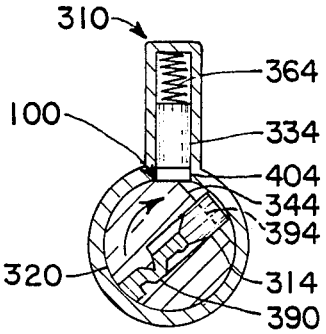
FIG. 67 is a cross-sectional view similar to FIGS. 65 and 66, but with the cylinder rotated an additional amount to show the cotter on the driver pin cammed completely out of the slot so that the lock can be successfully opened by the key therein.

As the cylinder 320 begins to rotate in the direction of the arrow in FIG. 66, the surface of the slot 344 in the cylinder 320 cams the cotter 404 in driver pin 344 upwardly into the top pin chamber. Then, as the cylinder 320 continues to rotate as shown in FIG. 67, the cotter 404 is cammed all the way out of the slot 344 to ride on the peripheral surface of the cylinder 320 as the cylinder is rotated to open the lock. When the cylinder 320 is turned back in the opposite direction, the reverse takes place so that the cotter 404 slides back downwardly into the slot 394 in the top of service pin 314 as the service pin 314 and driver pin 334 come into axial alignment with each other. This variation of the high security lock embodiment 210 has essentially the same security advantages as those described above for the embodiment 210 shown in FIGS. 49 through 58.

It is appropriate to mention that while the bottoms of the slots 342, 343, 344 are shown in FIGS. 63–67 to surface an angular spaced distance from the service pin chambers to cam the cotters out of the pin chambers in the cylinder, these slots could be extended at the same depth around the cylinder. Such arrangement would retain the security advantage of requiring the proper rotation of the pins in the cylinder to open the lock, but it would lack the above-described feature of having a common resistance in all pins to rising out of the pin chamber in the cylinder at the same time.

Although the rekeyable user and master level features of the high security embodiment 210 and variations thereof described above and shown in FIGS. 49 through 67 have not been described in significant detail, it should be understood that the level changes can be accomplished according to the detailed description of this invention for the preferred embodiment user and master level lock systems illustrated in FIGS. 2 through 42.

The above-described lock embodiments require that the particular latch mechanisms to which those lock embodiments are connected allow 180° rotation of the cylinders in order to effect removal of the level wafers via the notch in the spine of the key. However, there are many latch mechanisms to which locks are connected that do not allow full 180° rotation of the cylinder. In such environments, the above-described multiple rekeyable user and master level lock systems could not operate for the rekeyable functions. Therefore, the multiple levels of rekeyable user and master level lock systems described below are modifications of the embodiments described above that are specifically designed to work when connected to latches that do not allow full 180° rotation of the cylinders.

Figure 68:
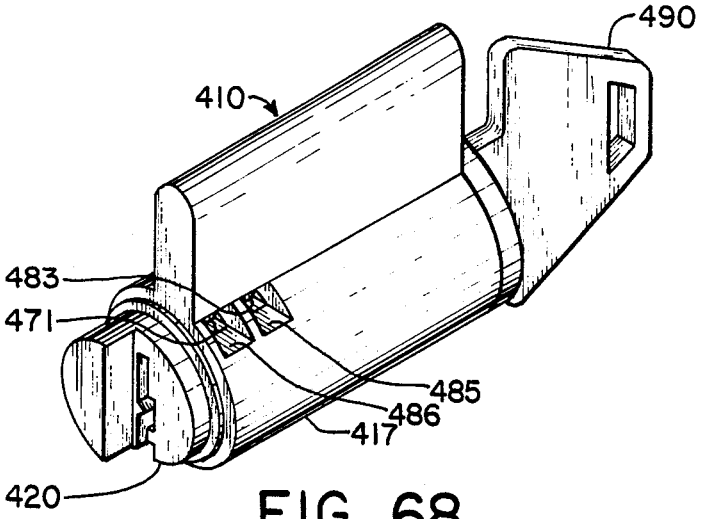
FIG. 68 is an isometric view of another embodiment of the multiple level user and master key system of the present invention which is suitable for uses in locks wherein rotation of the cylinder is limited by the latch mechanism to less than 180°.

The lock 410 shown in FIG. 68 is an embodiment of a multiple level rekeyable user and master key lock according to this invention that can be used with latch systems that do not accommodate cylinder rotation of 180°, but which do have some limited spaced outside the lock housing 417 into which the level wafers can be ejected. Such an environment is illustrated in FIGS. 69 and 70 wherein the lock 410 is installed in a typical conventional padlock 492.

The padlock 492 typically includes a main body portion 496 which houses a latch mechanism and the lock. The latch mechanism of the padlock is not a part of this invention, so it is not shown or described in detail. Suffice it to say that it is adapted to engage the hasp 493 when in locked conditions. The latch mechanism is connected to the lock 410 so that when the proper key 490 is inserted therein, the latch can be opened to release the hasp 493, thus allowing the padlock 492 to be opened.

The lock 410 is typically positioned in an open cavity or space 495 and retained therein by a retainer plate 494. In FIG. 70, the bottom of the padlock 492 is illustrated with the retainer 494 removed to show the open cavity 495 into which discarded level wafers can be ejected from the lock 410.

Figure 69:
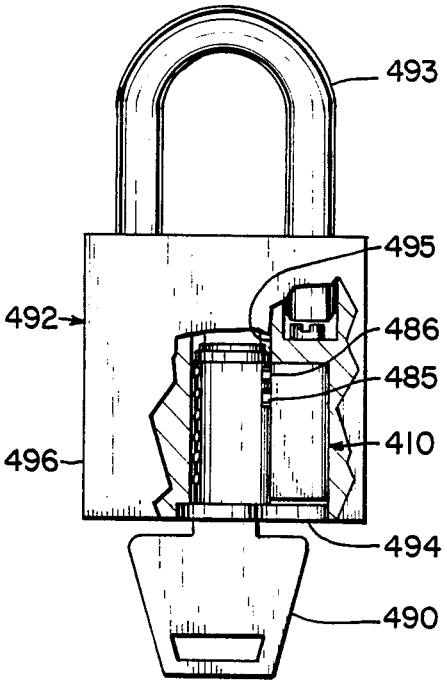
FIG. 69 is a side elevation view of a typical padlock with a portion of the side thereof cut away to illustrate the position of the lock embodiment shown in FIG. 63 therein.
Figure 70:
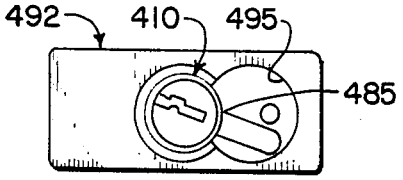
FIG. 70 is a bottom plan view of the padlock shown in FIG. 69 with the key removed and with the retainer mechanism removed to show the open chamber therein wherein removed level wafers can be discarded by the multiple level user and master key system shown in FIG. 68.

This lock embodiment 410, as shown in FIGS. 68 and 69, has two openings 485, 486 in the side of lock housing 417 through which level wafers can be ejected from the lock. In the illustrations of FIGS. 68 through 77, these ejection openings 485, 486 are aligned with and intersect the fifth and sixth pin chambers in the lock so that the description of its rekeying operation can parallel the description of the preferred embodiments above. It should be understood, however, that like those embodiments described above, these rekeying components could be utilized with the other pin chambers as well.

Figure 71:
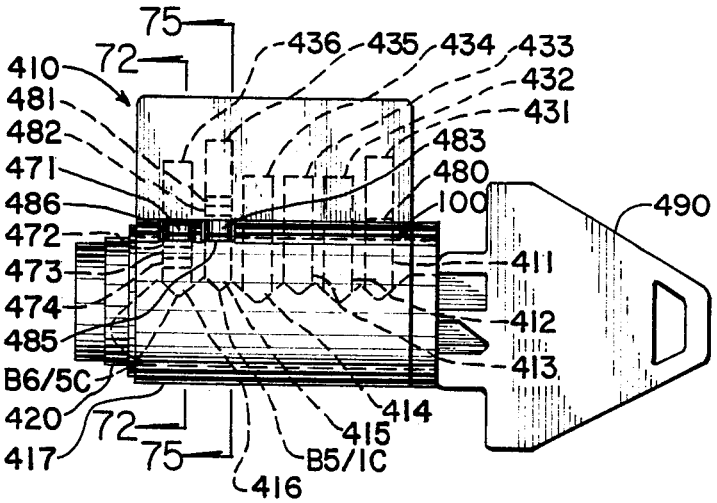
FIG. 71 is a side elevation view of the multiple level user and master key system shown in FIG. 68.

In the side elevation of the lock 410 shown in FIG. 71, the internal key and pin configurations are illustrated in broken lines. For consistency with the description of the foregoing embodiments above, the user level change wafers 472, 473, 474 are positioned in the sixth pin chamber, the master level change wafers 481, 482 are positioned in the fifth pin chamber, and the permanent master wafer 480 is positioned in the first pin chamber. The driver pins 431, 432, 433, 434, as well as the service pins 411, 412, 413, 414 and the permanent master wafer 480 in this embodiment all function the same as in those described above for the preferred embodiments illustrated in FIGS. 2 through 42. Therefore, there is no need for further description of these components for this lock embodiment 410.

The user and master level rekeying cut combinations described above for the preferred embodiments illustrated in FIGS. 2 through 42 also apply in general to the rekeying functions of this embodiment 410, with only several exceptions. Therefore, since the general rekeying principles can be gleaned from the description above, only the unique features of this embodiment will be described in detail herein.

Figure 72:
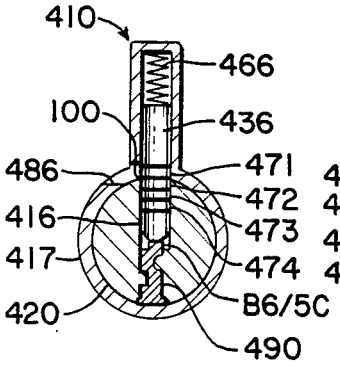
FIG. 72 is a cross-sectional view of the multiple level user and master key system of FIGS. 68 and 71 taken along line 72—72 of FIG. 71.
Figure 75:
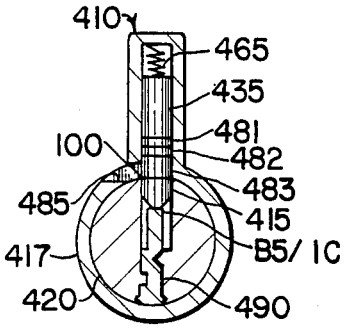
FIG. 75 is a cross-sectional view of the multiple level user and master key system of FIGS. 68 and 71 taken along line 75—75 of FIG. 71.

Referring now to FIGS. 71, 72, and 75, the pin and key configurations illustrated therein are shown with the user level change wafer 471 in position for being ejected from the lock 410 to change the user level keying thereof. Specifically, in the sixth pin chamber, three user level change wafers 471, 472, 473, 474 are shown positioned between the service pin 416 and the driver pin 436. The key 490 in this illustration has a B6/5C sixth bit to position the bottom surface of the top user level change wafer 471 at the shear line 100 on the surface of the cylinder 420. Therefore, the second, third, and fourth user level change wafers 472, 473, 474 are positioned inside the cylinder 420.

As best illustrated in FIGS. 71 and 72, the ejection opening 486 in the housing 417 is aligned with the user level 471 to be ejected. This ejection opening is wide enough to allow the user level wafer 471 to pass therethrough, as will be described in more detail below.

Before proceeding to the description of the user level wafer ejection, reference is made first to FIGS. 71 and 75 for an illustration of the corresponding positions of the master change wafers in the fifth pin position when the lock is positioned for ejection of a user level wafer 471. Specifically, the master level change wafers 481, 482 are positioned between the driver pin 435 and the service pin 415.

In addition, a double thickness (four cut) blocking wafer 483 is positioned under the master level change wafers 481, 482 and over the service pin 415. The fifth key bit of the key 490 has a B5/1C configuration for positioning the top of service pin 415 and the bottom of blocking wafer 483 at the shear line 100. In this position, the cylinder 420 is free to rotate, as shown in FIG. 75, but the ejection opening 485 in housing 417 is effectively blocked by the blocking wafer 483 to prevent ejection of the master level change wafers 481, 482. It should be noted that in this embodiment, the opening 485 is not wide enough to allow the passage therethrough of the blocking wafer 483. Thus, the blocking wafer 483 will be retained in this position while the cylinder 420 is rotated to eject the user level wafer 471 from the lock, as will now be described.

Figure 73:
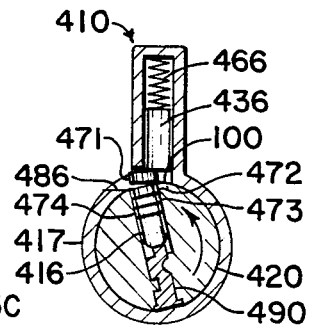
FIG. 73 is a cross-sectional view similar to FIG. 72, but with the cylinder of the lock rotated several degrees to illustrate the operational ejection of a level wafer therefrom.

Referring again to FIGS. 71–74, the ejection of the user level wafer 471 will now be described. First, as described above and shown in FIG. 72, the sixth key bit B6/5C has the user level wafer 471 positioned adjacent the opening 486 with the top of the user level change wafer 473 and the bottom of the user level change wafer 471 aligned with the shear line 100 of the lock so that the cylinder 420 can be rotated. Referring now to FIG. 73 in particular, as the cylinder 420 begins to rotate as indicated by the arrow, the friction between the user level wafer 471 and the user level wafer 472 tends to drive the user level wafer 472 into the ejection opening 486. This frictional engagement of wafers 471 and 472 is enhanced by the bias of spring 466.

Figure 74:
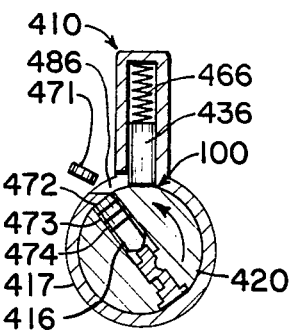
FIG. 74 is a cross-sectional view of the lock of FIGS. 68 and 71 similar to that shown in FIGS. 72 and 73, but with the cylinder rotated an additional several degrees to show the successful ejection of the level wafer therefrom according to this invention.

As the rotation of the cylinder 420 continues, as illustrated in FIG. 74, the user level wafer 471 is driven through the opening 486 and out of the lock 410. Thus, the keying combination for the user key is effectively changed by this operation. During this entire operation, as mentioned above, the rotation of the cylinder 420 does not affect the master keying combination, because the blocking wafer 483, as illustrated in FIG. 75, prevents the removal of any of the master level change wafers 481, 482.

Figure 76:
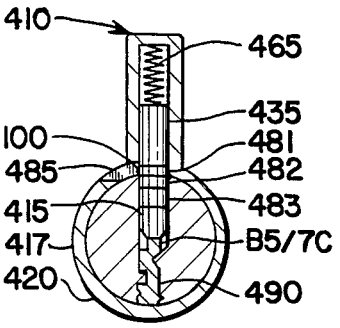
FIG. 76 is a cross-sectional view similar to FIG. 75, but illustrating a different master key therein for changing the keying of the lock for the master key part of the system.
Figure 77:
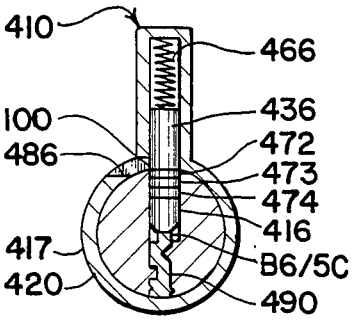
FIG. 77 is a cross-sectional view similar to that shown in FIG. 74, but with the cylinder in a position corresponding to that shown in FIG. 76 to illustrate the maintenance of the present user keying combination while changing the master key keying combination.

Next, reference is now made to FIGS. 77–77 to illustrate the operation of changing the master keying combination in this lock embodiment 410. A key 490 having a B5/7C and B6/5C bitting is inserted into the cylinder 420. The B5/7C bitting shown in FIG. 76 lowers the blocking wafer 483 and the second master level change wafer 482 into the cylinder 420, thus aligning the first master level change wafer 481 with the opening 485 in the housing 417. This B5/7C bitting also positions the bottom of master level change wafer 481 and the top of master level change wafer 482 in alignment with the shear line 100 so that the cylinder 420 can be rotated. At the same time, the B6/5C bitting shown in FIG. 77 positions the remaining user level change wafers 472, 473, 474 in the cylinder 420 with the bottom of driver pin 436 and the top of master level change wafer 472 aligned with the shear line 100 so that the cylinder 420 can be rotated. Then, with the master level wafer 481 aligned with the opening 485, as shown in FIG. 76, and the driver pin 436 blocking the opening 486, as shown in FIG. 77, the cylinder 420 can be rotated counter-clockwise to eject the master level wafer 481 from the lock through the opening 485, the same as described above for the ejection of the user level wafer.

Additional user and master level changes can be made in this lock embodiment 410 by changing the cuts of the key bittings essentially as described above for the key combination changes of the preferred embodiment illustrated in FIGS. 4–42. In this alternate embodiment 410, the user keys are also illustrated working off the shear line at the bottom of the driver pin 436 and the top of the service pin 415. At the same time, the master key for this embodiment 410 is illustrated working off the shear line at the top of the service pin 416 and the bottom of the driver pin 435. During use of any user key, the blocking wafer 483 prevents ejection of any remaining master level change wafers through the opening 485 to preserve the master level keying.

Figure 78:
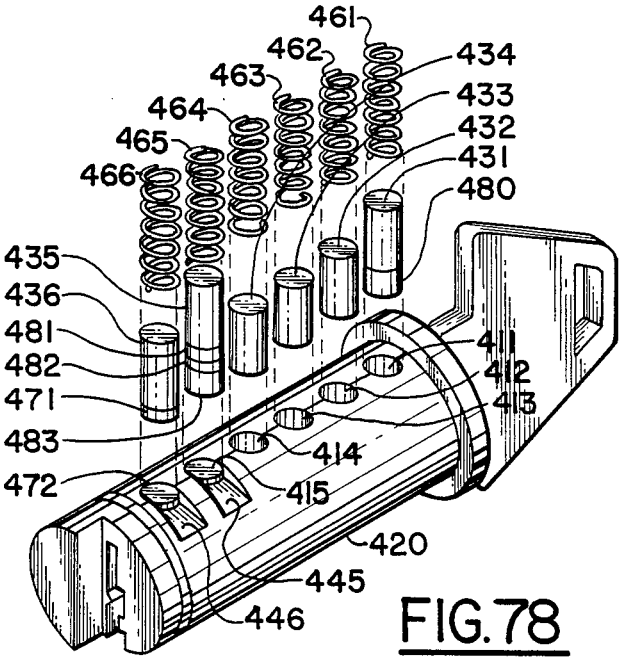
FIG. 78 is an isometric view of a modified cylinder of the multiple level user and master key system embodiment shown in FIG. 68.

As described above, the ejection of the user and master level change wafers depends on friction to drive the level change wafers through the openings 485, 486 and out of the lock 410. While this structure is quite reliable and efficient, it may be desirable to provide a positive engagement to drive the level change wafers out of the lock. Therefore, a variation 500 of the lock 410, which does provides a more positive engagement to drive the level change wafers out of the lock, is illustrated in FIGS. 78–82. The structure and operation of this variation 500 is much the same as the lock embodiment 410 described above and illustrated in FIGS. 68–77. However, this variation 500 includes two troughs 445, 446 recessed into the peripheral surface of the cylinder 420 and intersecting the respective chambers into which the fifth and sixth service pins 415, 416 are positioned. These recessed troughs 445, 446 are illustrated in FIG. 78. The function of these troughs is best shown in FIGS. 79–82, which are cross-sectional views of the sixth pin position of the lock 500.

Figure 79:
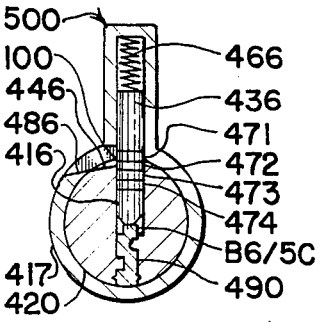
FIG. 79 is a cross-sectional view of the number 6 pin and chamber section of the multiple level user and master key system lock embodiment shown in FIG. 78 with a first level wafer therein positioned for removal.

Referring first primarily to FIGS. 78 and 79, this lock embodiment 500 appears in cross-section very similar to that shown in FIG. 72 for the previously described lock embodiment 410. However, the recessed trough 446 is shown in alignment with the ejection opening 486. Also like FIG. 72, the illustration in FIG. 79 shows a key 490 having a B6/5C bit in the sixth position to push the first user level change waver 471 above the shear line and into alignment with the ejection opening 486.

Figure 80:
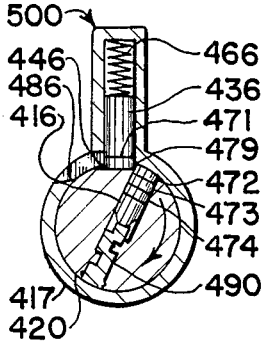
FIG. 80 is a cross-sectional view similar to FIG. 79, but with the cylinder rotated several degrees to illustrate the positive engagement of the level wafer to be removed therefrom.
Figure 81:
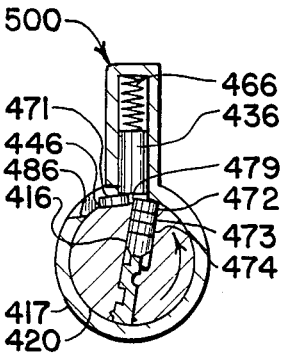
FIG. 81 is a cross-sectional view similar to that shown in FIGS. 79 and 80, but with the cylinder rotated several degrees in reverse to illustrate the operational removal of level wafer therefrom.
Figure 82:
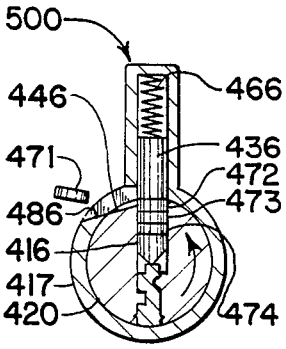
FIG. 82 is a cross-sectional view similar to FIGS. 79, 80, and 81, but with the cylinder rotated an additional several degrees to illustrate the successful ejection of the level wafer therefrom.

When the cylinder 420 in lock 500 is rotated clockwise, as indicated by the arrow in FIG. 80, the first user level change wafer 471 is forced by the bias of spring 466 downwardly into the trough 446 as soon as it can clear the second user level wafer 472. Then, as shown in FIG. 81, when the cylinder 420 is rotated oppositely in the counter-clockwise direction, the edge 479 of the second user level wafer 473 engages the first user level wafer 471 and drives it laterally into the ejection opening 486. When continued counter-clockwise rotation of the cylinder as shown in FIG. 82, the first user level wafer 471 is successfully ejected through the opening 486 and out of the lock 500.

The ejection of a master level change wafer 481, 482 with the assistance of the trough 445 is the same in function as just described above for the ejection of the user level change wafer 471. Therefore, further explanation or description of the process of changing the master level keying combination of this embodiment is not deemed necessary. Also, additional user and master level wafers can be ejected from the lock by providing user and master keys of different bitting combinations, as described above for the preferred embodiment illustrated in FIGS. 4–42. Therefore, it is also not considered necessary to further describe or explain the process of changing additional keying level combinations for this embodiment, which should now be understandable to persons having skill in this art from the description above.

Figure 83:
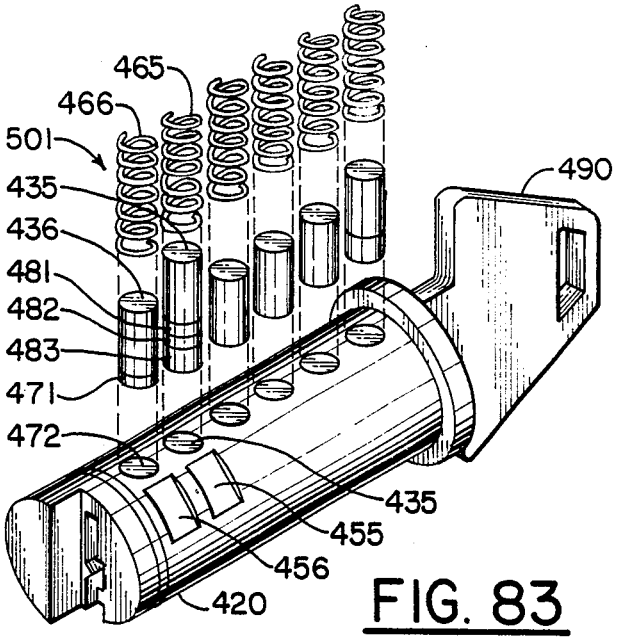
FIG. 83 is an isometric view of another modification of the multiple level user and master key system embodiment shown in FIG. 68.

Another variation 501 of the lock embodiments 410 and 500 described above is shown in FIGS. 83–87. This variation lock 501 is very similar to the embodiment 500 shown in FIGS. 78–82, with the exception that the recessed troughs 455, 456 in lock embodiment 501 are angularly offset from the pin chambers. However, these troughs 455, 456, which are also recessed into the peripheral surface of the cylinder 420, as shown in FIG. 83, also provide positive engagement of the level change wafers to be ejected. This wafer ejection operation in lock 501 will now be described with reference to FIGS. 84 through 87.

Figure 84:
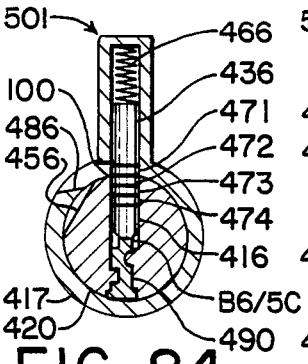
FIG. 84 is a cross-sectional view of the number 6 pin and chamber position of the lock shown in FIG. 83 with the first level wafer therein positioned for removal therefrom.
Figure 85:
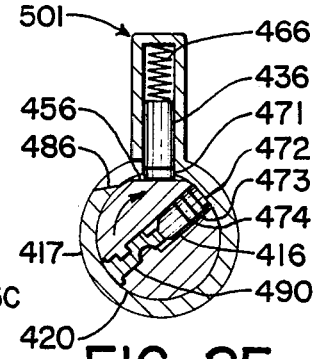
FIG. 85 is a cross-sectional view similar to that of FIG. 84, but with the cylinder rotated to engage the level wafer to be removed.
Figure 86:
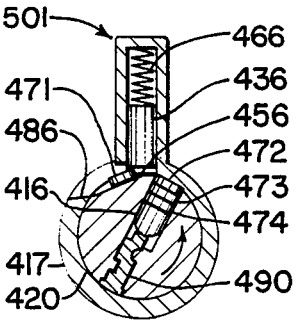
FIG. 86 is a cross-sectional view similar to FIGS. 84 and 85, but with the cylinder rotated in reverse direction to illustrate the operational removal of the first level wafer therefrom.
Figure 87:
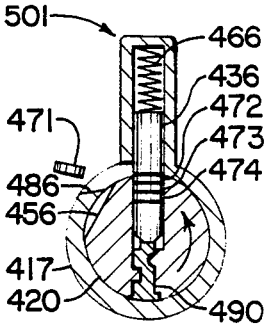
FIG. 87 is a cross-sectional view similar to FIGS. 84, 85, and 86, but with the cylinder rotated a sufficient amount in the reverse direction to successfully eject the first level wafer therefrom.

FIG. 84 is a cross-sectional view of the sixth pin position of lock 501, similar to those shown in FIGS. 72 and 79 for the respective embodiments 410 and 500 of the lock described above. As shown in FIG. 84, the recessed trough 456 is offset an angularly spaced distance from the chamber in the cylinder 420 containing the service pin 416 and the user level change wafers 471, 472, 473, 474. As also illustrated in FIG. 84, a key 490 having a B6/5C sixth bit is used to position the first user level change wafer 471 above the shear line 100 and in alignment with the ejection opening 486. When the cylinder 420 is rotated clockwise, as indicated by the arrow in FIG. 85, to a position where the recessed trough 456 is aligned with the driver pin 436, the bias of the spring 466 forces the first user level change wafer 471 downwardly into the recessed trough 456. Then, when the cylinder 420 is oppositely rotated in the counter-clockwise direction, as indicated in FIG. 86, the recessed trough 486 carries the first user level change wafer 471 into the opening 486. Continued counter-clockwise rotation of the cylinder 420, as shown in FIG. 87, results in successful ejection of the first user level change wafer 471 from the lock 501 to effect a change in the user keying combination of the lock 501.

Again, a change of a master level keying combination is accomplished essentially as described above for a change of a user level wafer, with the exception, of course, that the key bitting must be cut to position the master level change wafer to be ejected above the shear line 100 in alignment with the opening 485, while the user level change wafers are all positioned below the shear line 100 and not in alignment with the ejection opening 486. Such ejection of a master level change wafer according to this invention is described more fully above in reference to FIGS. 75–77, so it is not believed to be necessary to describe that operation again here.

Figure 88:
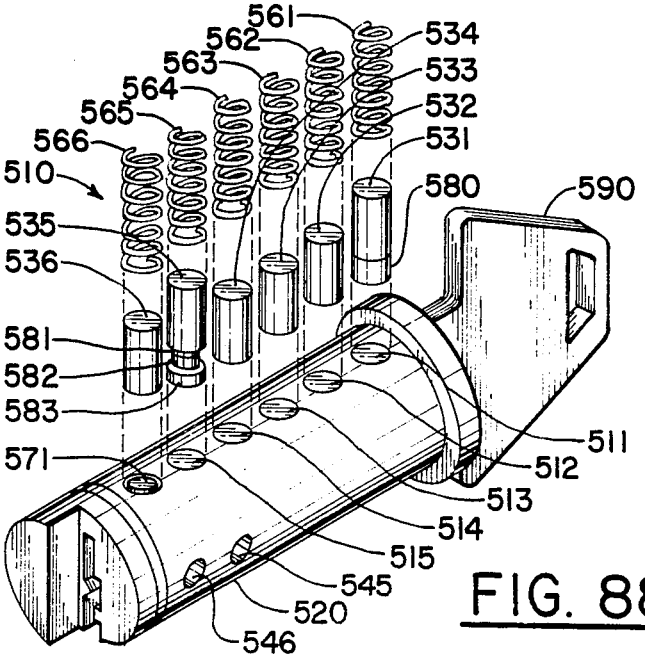
FIG. 88 is an isometric view of the cylinder and driver pins of another embodiment of the multiple level user and master key system of the present invention for use with latch mechanisms that do not accommodate 180° rotation of the cylinder.
Figure 89:
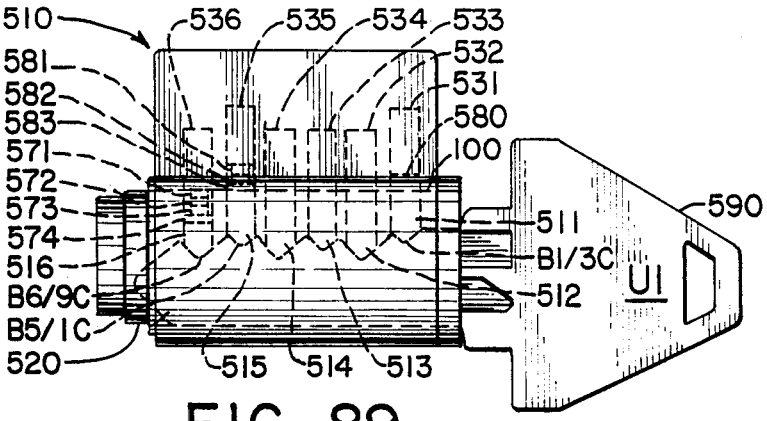
FIG. 89 is a side elevation view of the multiple level user and master key system shown in FIG. 88 with the operating mechanism therein illustrated in broken lines.

Another embodiment 510 of a rekeyable multiple level user and master key system according to this invention that can be operated with rotation of the cylinder less than 180° is illustrated in FIGS. 88–99. Referring primarily to FIGS. 88 and 89, this lock embodiment 510 has a cylinder 520 with service pins 511, 512, 413, 514, 515, 516 positioned therein. It also includes driver pins 531, 531, 533, 535, 536 biased by springs 561, 562, 563, 564, 565, 566 in a conventional manner. A permanent master wafer 580 is positioned under the driver pin 531 in the first pin chamber. Three user level change wafers 571, 572, 573 are positioned under the driver pin 536, and two master level change wafers 581, 582 are positioned under driver pin 535.

It is significant in this invention that the diameter of the user level change wafers 571, 572, 573, as well as the diameters of the master level change wafers 581, 582 are smaller than the diameters of the correspondingly respective service pins 515, 516 and driver pins 535, 536. Also, positioned between the user level change pin 573 and the service pin 516 is a blocking wafer 574. This blocking wafer 574 is of about the same diameter as the service pin 516 and driver pin 536. Likewise, a blocking wafer 583 is positioned between the master level change wafer 582 and the service pin 515. This blocking wafer 583 is also of approximately the same diameter as the service pin 515 and the driver pin 535.

As best shown in FIG. 88, this lock embodiment 510 also includes two spaced apart holes 545, 546 extending transversely into the cylinder 520 at angularly spaced distances from the fifth and sixth pin chambers in the cylinder 520. These holes 545, 546 are positioned such that upon rotation of the cylinder 520, they can be aligned with the level change wafers, as will be described more fully below. They are also deep enough to hold all the level change wafers to be dropped therein, preferably at least two or more of such wafers, according to this invention for multiple level rekeying capabilities.

The first level user key 590 illustrated in FIG. 89 is bitted similar to the first level user key described above in the preferred embodiment and illustrated in FIG. 4. In other words, it has a B6/9C sixth bit that is effective to position the bottom of the driver pin 536 on the shear line 100 and to position the user level change wafers 571, 572, 573 inside the cylinder 520. The 5B/1C fifth bit is effective to position the top of the service pin 515 at the shear line 100 with the master level change wafers 581, 582 and the blocking wafer 583 above the shear line 100. Thus, the first level user key 590, as shown in FIG. 89, works off the shear line at the bottom of driver pin 536 and off the shear line at the top of service pin 515.

Figure 90:
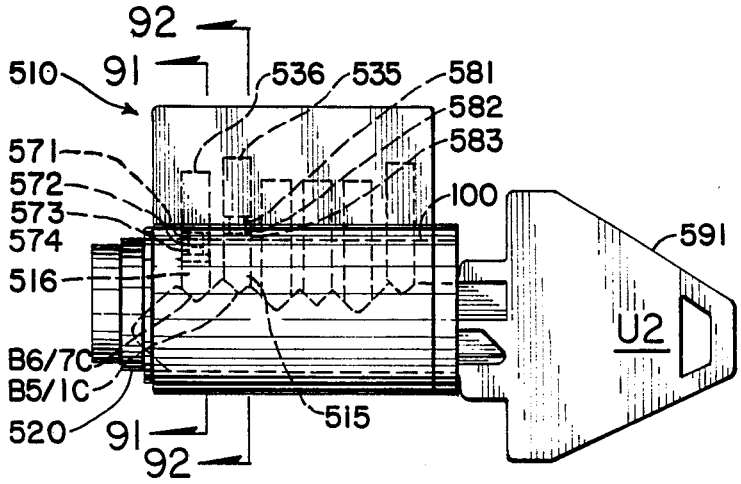
FIG. 90 is a side elevation view similar to FIG. 89, but with the first user level wafer positioned for removal therefrom.
Figure 91:
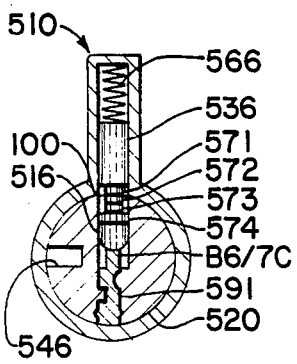
FIG. 91 is a cross-sectional view taken along line 91—91 of FIG. 90.
Figure 92:
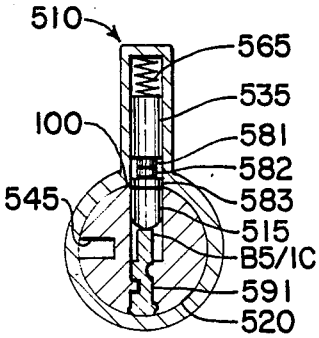
FIG. 92 is a cross-sectional view taken along line 92—92 of FIG. 90.

In order to rekey the lock 510 to the second user level, the second level user key 591 is positioned in the lock cylinder 520, as shown in FIG. 90. Referring now to FIGS. 90, 91, and 92, the B6/7C sixth bit in this second level user key 591 raises the first user level change wafer 571 above the shear line 100. The remaining user level change wafers 572, 573, as well as the blocking wafer 574 are left in the cylinder 520 below the shear line 100. At the same time, the B5/1C fifth bit on the second level user key 591 positions all of the master level change wafers 581, 582, as well as the blocking wafer 583 above the shear line 100.

Figure 93:
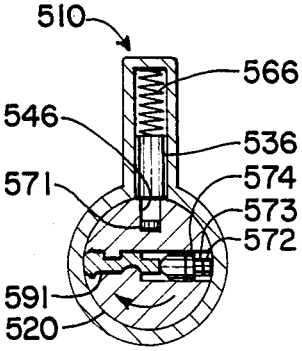
FIG. 93 is a cross-sectional view similar to that shown in FIG. 91, but with the cylider rotated 90° to effect the removal of the top level user wafer therefrom.
Figure 94:
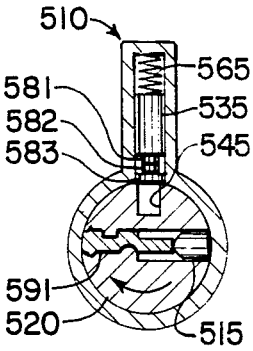
FIG. 94 is a cross-sectional view similar to FIG. 92, but with the cylinder rotates to a position corresponding to that shown in FIG. 93.

Then, as the cylinder 520 is rotated by the second lever user key 591, as shown in FIGS. 93 and 94, the user level change wafer 571, which was positioned above the shear line 100, is pushed by the bias of spring 566 into the hole 546 where it is captured. Since the hole 546 is smaller in diameter than the driver pin 536, the driver pin 536 cannot enter therein, thus the rotation of the cylinder 520 is unimpaired.

In the same operation wherein the user level change wafer 571 is captured in the hole 546, the hole 545 also comes into alignment with the master level change wafers 581, 582, as shown in FIG. 94. However, since the blocking wafer 583 is larger in diameter than the hole 545, the master level change wafers 581, 582 are effectively blocked out of the hole 545 so that no change in the master level keying is effected by this operation. The result is that the user level change wafer 571 is permanently captured in the hole 546 to change the user level keying while the master level keying is left unchanged.

When this description is considered in view of the more detailed description above of user level keying changes for the preferred embodiment 10 illustrated in FIGS. 4–42, it should be now be apparent that additional user level changes in this lock 510 can also be accomplished by subsequent user level keys that raise sequentially additional user level change wafers 572, 573 above the shear line and then rotating the cylinder 520 to capture the respective level change wafers as desired. Therefore, a further detailed description of such additional user level changes for this lock embodiment 510 should not be necessary. It is significant to mention, however, that the hole 546 is deep enough to also capture and hold the remaining user level change wafers 572, 573.

Figure 95:
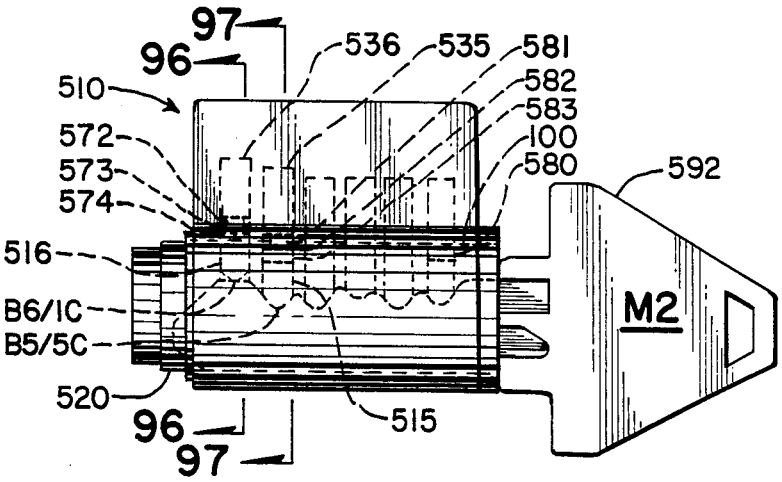
FIG. 95 is a side elevational view of the multiple level user and master key systems shown in FIGS. 88, 89, and 90, but with the top master level wafer positioned for removal therefrom.
Figure 96:
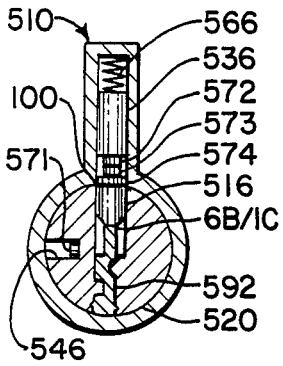
FIG. 96 is a cross-sectional view taken along line 96—96 of FIG. 95.
Figure 97:
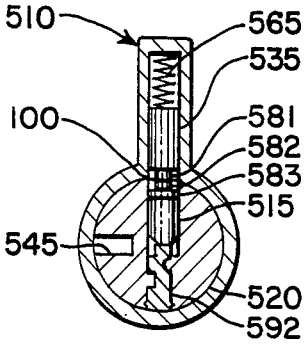
FIG. 97 is a cross-sectional view taken along line 97—97 of FIG. 95.
Figure 98:
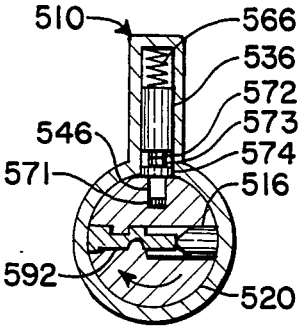
FIG. 98 is a cross-sectional view similar to FIG. 96, but rotated 90° to show the maintenance of the user level keying during changing of the master level keying.
Figure 99:
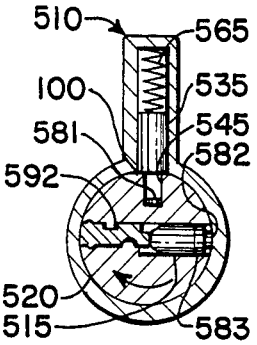
FIG. 99 is a cross-sectional view similar to FIG. 97, but with the cylinder rotated 90° to show the removal of the top master level wafer therefrom to effect rekeying of the master level keying system.

A change of the master level keying in lock 510 is best described by reference to FIGS. 95–99. The second level master key 592 having a B6/1C sixth bit and a B5/5C fifth bit is positioned in the lock 510. As shown in FIGS. 95 and 96, this second level master key 592 raises the remaining user level change wafers 572, 573, as well as the blocking wafer 574 above the shear line 100. At the same time, as shown in FIGS. 95 and 97, this second level master key 592 raises the first master level change key 581 above the shear line 100, while leaving the remaining master level change wafer 582 and the blocking wafer 583 in the cylinder 520 below the shear line 100. Then, as illustrated in FIGS. 98 and 99, when the cylinder 520 is rotated to align the hole 546 with the remaining user level change wafers 572, 573, the larger diameter blocking wafer 574 prevents the user level change wafers 572, 573 from entering the hole 546. Thus, the user level keying is left unchanged. At the same time, however, as shown in FIG. 99, the master level change wafer 581 that had been positioned above the shear line 100 is pushed by the bias of spring 565 into the hole 545 where it is permanently captured, thus effecting a change in the master level keying. Again, the larger diameter driver pin 535 cannot enter the hole 545, thus the rotation of the cylinder 520 is left unimpaired.

An additional change in the master level keying can be accomplished by using a third master level key that positions the master level change wafer 582 above the shear line and then rotating the cylinder 520 until that master level change wafer 582 drops into the hole 545.

For purposes of illustration and not of limitation, the driver pins 535, 536 and the service pins 515, 516 of lock 510 can be of a conventional diameter, for example 0.115 inches. The blocking wafers 574 and 583 can also be of the same 0.115 inch diameter as the driver and service pins. The user level change wafers 571, 572, 573, as well as the master level change wafers 581, 582 can be of approximately 0.095 inches. The holes 545, 546 can be approximately 0.100 inches in diameter, which is large enough to capture the level change wafers, but small enough to exclude the blocking wafers and the driver pins. The holes 545, 546 should be of sufficient depth to accept all of the level change wafers desired to be captured for rekeying the lock. For example, where each level change wafer has a two-cut thickness, i.e., approximately 0.030 inches, a hole depth of approximately 0.095 inches should be sufficient to capture three of such wafers.

From the above descriptions of the various embodiments and modifications of the present invention, it should be understood that each of the rekeyable locks disclosed here can be combined with selected ones or all high security enhancement features disclosed herein. In other words, each of the rekeyable lock embodiments of this invention can be enhanced in security to the extent desired by use of the security enhancing apparatus of this invention.

It should also be understood that positions of user and master level pin wafers can be interchanged with respect to pin chambers, over or under the shear line, or the use of blocking wafers to retain the keying of a user or master system while the keying of the other is being changed. Therefore, many rearrangements of such positions of these components can be made in locks having a number of pin chambers which would be functional and structural equivalents to the particular arrangements described in detail above.

The foregoing description is considered as illustrative only of the principles of the invention to enable persons of ordinary skill in the art to practice the invention. Further, since numerous modifications and changes will readily occur to those skilled in the art, it is not desired to limit the invention to the exact construction and processes shown and described. Therefore, the scope of this invention includes all suitable modifications and equivalents that fall within the scope of the invention as defined by the claims which follow.

The embodiments of the invention in which exclusive property rights or privileges are claimed are defined as follows:

1. In lock apparatus having a housing, a cylinder rotatably positioned in said housing with a longitudinal keyway therein, a plurality of pin chambers extending radially from said housing into said cylinder to intersect said keyway, driver pins slideably positioned in the housing portions of said pin chambers and service pins positioned in the cylinder portions of said pin chamber, the interface between said cylinder and said housing defining a shear plane through which said driver and service pin can extend to prevent rotation of said cylinder in said housing, the improvement of a multiple level rekeyable user and master key system comprising:

removable first user level spacer means positioned in one of said common pin chambers between the driver and service pins therein;

removable master first level spacer means positioned in another of said common pin chambers between the driver and service pins therein;

a user key having bitting means thereon for positioning the bottom of the driver pin in said one common pin chamber at said shear plane and the top of the service pin in the other of said common pin chambers at said shear plane;

a master key having bitting means thereon for positioning the top of the service pin in said one common chamber at said shear plane and the bottom of the driver pin in the other of said common pin chambers at said shear plane;

removal means for removing said first user level spacer means from said one common pin chamber;

removal means for removing said first master level spacer means from said other common pin chamber; and permanent master spacer means positioned in a third common pin chamber between the driver and service pins therein, and wherein said user key has bitting means thereon for positioning the top of the service pin in said third common pin chamber at said shear plane and said master key has bitting means thereon for positioning the bottom of the driver pin in said third common pin chamber at said shear plane.

2. The improvement of claim 1, including a plurality of user level spacer means positioned in one of said common pin chambers between the driver and service pins therein, removal means for selectively removing said user level spacer means one at a time from said one common pin chamber, and a plurality of user key means, one of which includes bitting means for positioning the bottom of the driver pin in said one common pin chamber at the shear plane for each user level spacer means.

3. The improvement of claim 2, including a plurality of master level spacer means positioned in the other of said common pin chambers between the driver and service pins therein, removal means for selectively removing said master level spacer means one at a time from said other common pin chamber, and a plurality of master key means, one of which includes bitting means for positioning the bottom of the driver pin in said other common pin chamber at the shear plane for each master level spacer means.

4. The improvement of claim 1, wherein the keyway in the cylinder opens to the peripheral surface of the cylinder on the side thereof diagonally opposite the openings of the pin chambers in the peripheral surface of the cylinder, said removal means for said user level spacer means includes a user key having bitting means thereon effective to position said user level spacer means above the shear plane and a recessed notch in the spine of said user key alignable with said one common chamber and sized to receive therein said user level spacer means.

5. The improvement of claim 4, including said removal means for said master level spacer means includes a master key having bitting means thereon effective to position said user level spacer means above the shear plane and a recessed notch in the spine of the user key alignable with said other common chamber and sized to receive therein said master level spacer means.

6. The improvement of claim 4, including camming means in said keyway for camming the driver pin out of the notch and keyway.

7. The improvement of claim 6, wherein said camming means includes the cylinder with a bevelled edge in said keyway where the keyway intersects the peripheral surface of the cylinder.

8. The improvement of claim 7, wherein said bevelled edge extends longitudinally along the length of the keyway.

9. The improvement of claim 7, wherein said bevelled edge is in a circular configuration around said notch when the key is in the keyway forming a recessed pocket around the notch in the peripheral surface of the cylinder.

10. The improvement of claim 2, wherein said user level spacer means includes a plurality of pin wafers stacked together and positioned in said one common pin chamber.

11. The improvement of claim 10, wherein the wafers in said stack are adhered together.

12. The improvement of claim 10, wherein said pin wafers have holes through their centers and are positioned on a core of solid, frangible material extending through said holes.

13. The improvement of claim 12, wherein said material contains a lubricant.

14. The improvement of claim 10, including a sleeve of solid, frangible material with said pin wafers positioned in said sleeve.

15. The improvemet of claim 14, wherein said material contains a lubricant.

16. The improvement of claim 1, including a driver pin with cotter means extending from one end thereof in one of said common chambers and a service pin in the same common chamber having a slotted opening in one end sized and shaped to receive said cotter means therein.

17. The improvement of claim 16, including pin rotating means for rotating said service pin to a position where said slotted opening is oriented transverse to the longitudinal axis of the cylinder.

18. The improvement of claim 17, including camming means for camming said cotter means out of said slotted opening.

19. The improvement of claim 18, wherein said camming means includes a rounded surface on the distal end of said cotter means.

20. The improvement of claim 18, wherein said camming means includes a slot recessed into the peripheral surface of the cylinder that extends said slotted opening in the service pin when said slotted opening is oriented transverse to the longitudinal axis of the cylinder.

21. The improvement of claim 20, wherein said recessed slot is the same depth as the length of said cotter means adjacent the service pin and extends to intersect the peripheral surface of the cylinder a spaced distance from the service pin.

22. The improvement of claim 1, wherein said removal means for said user level spacer means includes said housing with an ejection opening therein intersecting said one common pin chamber, and a user key with bitting means thereon for positioning said user level spacer means adjacent said ejection opening.

23. The improvement of claim 22, wherein said removal means for said master level spacer means includes said housing with an ejection opening therein intersecting said other common pin chamber, and a master key with bitting means thereon for positioning said master level spacer means adjacent said ejection opening that intersects said other common pin chamber.

24. The improvement of claim 23, including blocking means in said other common pin chamber for preventing removal of said master level spacer means from said other common pin chamber when said user level spacer means is being removed from said other common pin chamber.

25. The improvement of claim 24, wherein said user level spacer means is a user level pin wafer and said ejection opening that intersects said one common pin chamber is positioned to align with said user level pin wafer when said user level pin wafer is positioned with its bottom surface on the shear plane over the cylinder and is large enough to allow passage therethrough of said user level pin wafer.

26. The improvement of claim 25, wherein said master level spacer means is a master level pin wafer and said ejection opening that intersects said other common pin chamber is positioned to align with said master level pin wafer when said master level pin wafer is positioned with its bottom surface on the shear plane over the cylinder and is large enough to allow passage therethrough of said master level pin wafer.

27. The improvement of claim 26, wherein said blocking means includes a blocking pin wafer larger in size than said ejection hole that intersects said other common pin chamber and a user key having bitting means thereon for positioning said blocking pin wafer adjacent said ejection hole where it intersects said other common pin chamber and with the bottom surface of said blocking pin on the shear plane.

28. The improvement of claim 27, including a trough recessed into the peripheral surface of the cylinder adjacent said one common pin chamber and another trough recessed into the peripheral surface of the cylinder adjacent said other common pin chamber.

29. The improvement of claim 28, wherein said troughs intersect the respective common pin chambers.

30. The improvement of claim 28, wherein said troughs are spaced apart from the respective common pin chambers.

31. The improvement of claim 1, wherein said user level spacer means includes a user pin wafer smaller in diameter than the driver pin in said one common pin chamber, said master level spacer means includes a master pin wafer smaller in diameter than the driver pin in said other common pin chamber, said removal means for said user level spacer means includes a user pin wafer capture hole in the peripheral surface of the cylinder an angularly spaced distance from said one common pin chamber and smaller in diameter than the driver pin but large enough to receive said user pin wafer therein and a user key having bitting means thereon for positioning said user pin wafer above the shear plane and said removal means for said master level spacer means includes a master pin wafer capture hole in the peripheral surface of the cylinder an angular spaced distance from said other common pin chamber and smaller in diameter than the driver pin but large enough to receive said master pin wafer therein and a master key having bitting means thereon for positioning said master pin wafer over the shear plane.

32. The improvement of claim 31, including first blocking means in said one common pin chamber for selectively blocking said user pin wafer from entering said user pin wafer capture hole, and second blocking means for selectively blocking said master pin wafer from entering said master pin wafer capture hole.

33. The improvement of claim 32, wherein said first blocking means includes a first blocking pin wafer larger in diameter than said user pin wafer capture hole positioned in said one common pin chamber between said user pin wafer and the service pin therein, and said second blocking means includes a second blocking pin wafer larger in diameter than said master pin wafer capture hole positioned in said other common pin chamber between said master pin wafer and the service pin therein.

34. In rekeyable lock apparatus having a housing, a cylinder rotatably positioned in said housing with a longitudinal keyway therein that opens to the peripheral surface of the cylinder, a pin chamber extending radially from said housing into the side of said cylinder diagonally opposite said opening of the keyway in the peripheral surface of the cylinder to intersect said keyway inside said cylinder, a driver pin slideably positioned in the housing portion of said pin chamber and a service pin positioned in the cylinder portion of said pin chamber, the interface between said cylinder and said housing defining a shear plane through which said driver pin and said service pin can extend to prevent rotation of said cylinder in said housing, a removable pin wafer positioned in said pin chamber between said driver pin and said service pin, a key adapted for insertion into the keyway having bitting thereon cut to position said removable pin wafer in the housing portion of the pin chamber and a notch in the spine of the key transversely aligned with said bitting, the improvement comprising:

camming means for camming the driver pin out of the notch and keyway.

35. The improvement of claim 34, wherein said camming means includes the cylinder with a bevelled edge in said keyway where the keyway intersects the peripheral surface of the cylinder.

36. The improvement of claim 35 wherein said bevelled edge extends longitudinally along the length of the keyway.

37. The improvement of claim 35, wherein said bevelled edge is in a circular configuration around said notch when the key is in the keyway forming a recessed pocket around the notch in the peripheral surface of the cylinder.

38. In lock apparatus having a housing, a cylinder rotatably positioned in said housing with a longitudinal keyway therein, a pin chamber extending radially from said housing into said cylinder to intersect said keyway, a driver pin slideably positioned in the housing portion of said pin chamber and a service pin slideably positioned in the cylinder portion of said pin chamber, and a plurality of pin wafers positioned between said driver pin and said service pin, the improvement comprising said pin wafers being attached together by an adhesive material in a common stack in such a manner that each of such pin wafers in the stack is immoveable in relation to the others.

39. In lock apparatus having a housing, a cylinder rotatably positioned in said housing with a longitudinal keyway therein, a pin chamber extending radially from said housing into said cylinder to intersect said keyway, a driver pin slideably positioned in the housing portion of said pin chamber and a service pin slideably positioned in the cylinder portion of said pin chamber, and a plurality of pin wafers positioned between said driver pin and said service pin, the improvement comprising said pin wafers being attached together in a common stack in such a manner that each of such pin wafers in the stack is immoveable in relation to the others, wherein each of said pin wafers has an axial hole therethrough and an elongated core of solid, frangible material is positioned through said holes in said pin wafers.

40. The improvement of claim 39, wherein said solid, frangible material contains a lubricant.

41. In lock apparatus having a housing, a cylinder rotatably positioned in said housing with a longitudinal keyway therein, a pin chamber extending radially from said housing into said cylinder to intersect said keyway, a driver pin slideably positioned in the housing portion of said pin chamber and a service pin slideably positioned in the cylinder portion of said pin chamber, and a plurality of pin wafers positioned between said driver pin and said service pin, the improvement comprising said pin wafers being attached together in a common stack in such a manner that each of such pin wafers in the stack is immoveable in relation to the others, including a sleeve of solid, frangible material with said pin wafers positioned in said sleeve.

42. In rekeyable lock apparatus having a housing, a cylinder rotatably positioned in said housing with a longitudinal keyway therein, a pin chamber extending radially from said housing into said cylinder to intersect said keyway, a driver pin slideably positioned in the housing portion of said pin chamber and a service pin slideably positioned in the cylinder portion of said pin chamber, the interface between said cylinder and said housing defining a shear plane, and a pin wafer positioned between said driver and said service pins, the improvement comprising said housing having an ejection opening therein intersecting said pin chamber, a trough recessed into the peripheral surface of said cylinder adjacent the pin chamber in the cylinder, and a key having bitting means thereon for positioning said pin wafer in said pin chamber adjacent said ejection opening.

43. The improvement of claim 42, wherein said trough intersects said pin chamber in said cylinder.

44. The improvement of claim 42, wherein said trough is an angularly spaced distance from said pin chamber in said cylinder.

45. In rekeyable lock apparatus having a housing, a cylinder rotatably positioned in said housing with a longitudinal keyway therein, a pin chamber extending radially from said housing into said cylinder to intersect said keyway, a driver pin slideably positioned in the housing portion of said pin chamber and a service pin slideably positioned in the cylinder portion of said pin chamber, the interface between said cylinder and said housing defining a shear plane, the improvement comprising:

said cylinder having a capture hole extending therein from the peripheral surface thereof an angularly spaced distance from said pin chamber in said cylinder, which capture hole is smaller in diameter than said driver pin;

a level pin wafer positioned in said pin chamber between said driver pin and said service pin, said pin wafer being of small enough diameter to be receivable into said capture hole;

a blocking pin wafer larger in diameter than said capture hole and positioned in said pin chamber between said level pin wafer and said service pin.

46. The improvements of claim 45, including a first key having first bitting means thereon for positioning the level pin wafer above the shear plane and the blocking wafer below the shear plane.

47. The improvement of claim 46, including a second key having second bitting means thereon for positioning the blocking pin wafer above the shear plane and the service pin below the shear plane.

48. The improvement of claim 45, including a plurality of level pin wafers positioned in said pin chamber between said driver pin and said blocking pin wafer, said level pin wafers being small enough in diameter to be received into said capture hole, and said capture hole extending deep enough into said cylinder to be able to contain and hold all of said level pin wafers.

49. The improvement of claim 48, including said first key means with said first bitting means thereon for positioning any selected one of said level pin wafers above the shear plane and the blocking pin wafer below the shear plane.

50. The improvement of claim 48, including said second key means with said second bitting means thereon for positioning said blocking pin wafer above the shear plane and the service pin below the shear plane.

51. The method of rekeying lock apparatus having a housing, a cylinder rotatably positioned in said housing with a longitudinal keyway therein, a plurality of pin chambers extending radially from said housing into said cylinder to intersect said keyway, driver pins slideably positioned in the housing portions of said pin chambers and service pins positioned in the cylinder portions of said pin chambers, the interface between said cylinder and said housing defining a shear plane through which said driver and service pins can extend to prevent rotation of said cylinder in said housing, the improvement of a multiple level rekeyable user and master key system comprising the steps of:

positioning removable first user level spacer means in one of said common pin chambers between the driver and service pins therein;

positioning removable master first level spacer means in another of said common pin chambers between the driver and service pins therein;

positioning permanent master spacer means in a third common pin chamber between the driver and service pins therein;

removing said first user level spacer means from said one of said common pin chambers by inserting a user key having bitting means thereon for positioning the bottom of the first user level spacer means in said one common pin chamber at said shear plane and the top of the service pin in the other of said common pin chambers at said shear plane and having bitting means thereon for positioning the top of the service pin in said third common pin chamber at said shear plane;

ejecting said first user level spacer means from said one common pin chamber;

removing said first master level spacer means from the other of said common pin chambers by inserting a master key having bitting means thereon for positioning the top of the service pin in said one common chamber at said shear plane and the bottom of the first master level spacer means in the other of said common pin chambers at said shear plane and having bitting means thereon for positioning the bottom of the driver pin in said third common pin chamber at said shear plane; and ejecting said first master level spacer means from said other common pin chamber.

52. The method of claim 51, including the steps of positioning a plurality of user level spacer means in one of said common pin chambers between the driver and service pins therein, and using one of a plurality of user keys that has bitting means for positioning the bottom of the selected user level spacer means to be removed at the shear plane for each user level spacer means.

53. The improvement of claim 52, including the steps of positioning a plurality of master level spacer means in the other of said common pin chambers between the driver and service pins therein, and using one of a plurality of master keys that has bitting means for positioning the bottom of the selected master level spacer means to be removed at the shear plane for each master level spacer means.

54. The method of claim 51, including the step of removing said user level spacer means by inserting into the keyway a user key having bitting means thereon for positioning the bottom of the first user level spacer means in said one common pin chamber at said shear plane and the top of the service pin in the other of said common pin chambers at said shear plane, said key also having a notch in its spine deep enough to capture said first level spacer means therein;

rotating the cylinder to capture the first level spacer means in the notch then rotating the cylinder to realign the pin chambers in the housing and cylinder;

removing the user key and first user level spacer means from the keyway.

55. The method of claim 54, including the step of removing said first master level spacer means from said other common pin chamber by inserting into the keyway a master key having bitting means thereon for positioning the top of the service pin in said one common chamber at said shear plane and the bottom of the first master level spacer means in the other of said common pin chambers at said shear plane;

rotating the cylinder to capture the first level spacer means in the notch, then rotating the cylinder to realign the pin chambers in the housing and cylinder; and removing the master key and first master level spacer means from the keyway.

56. The method of claim 51, including the step of removing said user level spacer means by ejecting said user level spacer means through an opening in the housing that intersects said one common pin chamber, including the additional steps of using a user key with bitting means thereon for positioning said user level spacer means adjacent said ejection opening and rotating the cylinder toward said opening.

57. The method of claim 56, including the step of removing said master level spacer means by ejecting said master level spacer means through an opening in the housing that intersects said other common pin chamber, including the additional steps of using a master key with bitting means thereon for positioning said master level spacer means adjacent said ejection opening that intersects said other common pin chamber and rotating the cylinder toward said opening.

58. The improvement of claim 57, including the step of positioning blocking means in said other common pin chamber and positioning the blocking means adjacent the ejection opening in said other common pin chamber for preventing removal of said master level spacer means from said other common pin chamber when said user level spacer means is being removed from said other common pin chamber.

59. The method of claim 58, including the steps of forming a trough recessed into the peripheral surface of the cylinder adjacent said one common pin chamber and forming another trough recessed into the peripheral surface of the cylinder adjacent said other common pin chamber and rotating the cylinder until the level removal means to be removed drops into the trough and then rotating the cylinder toward the ejection opening to eject the level removal means.

60. The method of claim 59, including the steps of forming said troughs to intersect the respective common pin chambers.

61. The improvement of claim 59, including the step of forming said troughs at angularly spaced apart positions from the respective common pin chambers.

62. The improvement of claim 51, including the steps of positioning user level spacer means in the form of a user pin wafer smaller in diameter than the driver pin in said one common pin chamber, positioning master level spacer means in the form of a master pin wafer smaller in diameter than the driver pin in said other common pin chamber, providing user pin wafer capture holes in the peripheral surface of the cylinder angularly spaced distances from said respective common pin chambers and smaller in diameter than the driver pins but large enough to receive said respective user and master pin wafers therein, removing said user pin wafer by positioning said user pin wafer above the shear plane and rotating the cylinder to capture the user pin wafer in the capture hole, and removing said master pin wafer by positioning said master pin wafer over the shear plane and rotating the cylinder to capture the master pin wafer in the capture hole.

63. The method of claim 62, including the steps of positioning a first blocking pin wafer larger in diameter than said user pin wafer capture hole in said one common pin chamber between said user pin wafer and the service pin therein, and positioning a second blocking pin wafer larger in diameter than said master pin wafer capture hole in said other common pin chamber between said master pin wafer and the service pin therein.

64. In rekeyable lock apparatus having a housing, a cylinder rotatably positioned in said housing with a longitudinal keyway therein that opens to the peripheral surface of the cylinder, a pin chamber extending radially from said housing into the side of said cylinder diagonally opposite said opening of the keyway in the peripheral surface of the cylinder to intersect said keyway inside said cylinder, a driver pin slidably positioned in the housing portion of said pin chamber and a service pin positioned in the cylinder portion of said pin chamber, the interface between said cylinder and said housing defining a shear plane through which said driver pin and said service pin can extend to prevent rotation of said cylinder in said housing, a removable pin wafer positioned in said pin chamber between said driver pin and said service pin, a key adapted for insertion into the keyway having bitting thereon cut to position said removable pin wafer in the housing portion of the pin chamber and a notch in the spine of the key transversely aligned with said bitting, the method of preventing disablement of the lock comprising the step of camming the driver pin out of the notch and keyway when the driver pin falls therein upon alignment with the notch and keyway after the removable pin wafer has been removed by bevelling the edge in said keyway where the keyway intersects the peripheral surface of the cylinder and turning the cylinder to cause the bevelled edge to apply an upward force vector on the driver pin.

65. In lock apparatus having a housing, a cylinder rotatably positioned in said housing with a longitudinal keyway therein, a pin chamber extending radially from said housing into said cylinder to intersect said keyway, a driver pin slideably positioned in the housing portion of said pin chamber and a service pin slideably positioned in the cylinder portion of said pin chamber, and a plurality of pin wafers positioned between said driver pin and said service pin, the method of increasing security of the lock comprising the steps of releaseably fastening said pin wafers together by an adhesive material in a common stack in such a manner that each of such pin wafers in the stack is temporarily immoveable in relation to the others.

66. In lock apparatus having a housing, a cylinder rotatably positioned in said housing with a longitudinal keyway therein, a pin chamber extending radially from said housing into said cylinder to intersect said keyway, a driver pin slideably positioned in the housing portion of said pin chamber and a service pin slideably positioned in the cylinder portion of said pin chamber, and a plurality of pin wafers positioned between said driver pin and said service pin, the method of increasing security of the lock comprising the steps of releaseably fastening said pin wafers together in a common stack in such a manner that each of such pin wafers in the stack is temporarily immoveable in relation to the others and including the steps of fastening said pin wafers together by providing an axial hole through each wafer and positioning an elongated core of solid, frangible material through said holes in said pin wafers.

67. The method of claim 66, including the step of providing a lubricant in said solid, frangible material.

68. In lock apparatus having a housing, a cylinder rotatably positioned in said housing with a longitudinal keyway therein, a pin chamber extending radially from said housing into said cylinder to intersect said keyway, a driver pin slideably positioned in the housing portion of said pin chamber and a service pin slideably positioned in the cylinder portion of said pin chamber, and a plurality of pin wafers positioned between said driver pin and said service pin, the method of increasing security of the lock comprising the steps of releaseably fastening said pin wafers together in a common stack in such a manner that each of such pin wafers in the stack is temporarily immoveable in relation to the others and including the step of positioning said pin wafers in a sleeve of solid, frangile material.

69. The improvement of claim 68, including the step of providing a lubricant in said solid, frangile material.

70. In lock apparatus having a housing, a cylinder rotatably positioned in said housing with a longitudinal keyway therein, a pin chamber extending radially from said housing into said cylinder to intersect said keyway, a driver pin slideably positioned in the housing portion of said pin chamber and a service pin slideably positioned in the cylinder portion of said pin chamber, the interface between said cylinder and said housing defining a shear plane through which said driver pin and said service pin can extend to prevent rotation of the cylinder in said housing, the method of increasing security of the lock comprising the steps of:

providing a transverse slot in the top end of the service pin that interfaces with the driver pin, providing cotter means on the bottom of the driver pin for insertion into said slot in said service pin;

opening said lock by rotating said service pin in said pin chamber to align said slot in said service pin to a plane normal to the longitudinal axis of said cylinder; and camming said driver pin and cotter means out of the pin chamber in said cylinder.

71. The method of claim 70, including the steps of camming the driver pin and cotter means by providing a rounded surface on the bottom of said cotter means and rotating the cylinder to bear the edge of the pin hole on the rounded surface.

72. The method of claim 70, including the steps of providing a transverse slot recessed into the peripheral surface of said cylinder adjacent to, and intersecting with, said pin chamber in the cylinder and in said plane normal to the longitudinal axis of said cylinder, making said transverse slot at least as deep adjacent said pin chamber as the extent of the protrusion of the cotter means into the slot in the service pin and extending it to the peripheral surface of the cylinder an angularly spaced distance from said pin chamber, and rotating the cylinder to bear the bottom of said transverse slot against the cotter.

73. In rekeyable lock apparatus having a housing, a cylinder rotatably positioned in said housing with a longitudinal keyway therein, a pin chamber extending radially from said housing into said cylinder to intersect said keyway, a driver pin slideably positioned in the housing portion of said pin chamber and a service pin slideably positioned in the cylinder portion of said pin chamber, the interface between said cylinder and said housing defining a shear plane, and a pin wafer positioned between said driver and said service pins, the method of removing the pin wafer comprising the steps of providing an ejection opening in said housing intersecting said pin chamber, providing a trough recessed into the peripheral surface of said cylinder adjacent the pin chamber in the cylinder, positioning said pin wafer in said pin chamber adjacent said ejection opening, rotating the cylinder until the trough receives the pin wafer, and rotating the cylinder toward said ejection opening.

74. The method of claim 73, including the step of positioning said trough to intersect said pin chamber in said cylinder.

75. The method of claim 73, including the step of positioning said trough an angularly spaced distance from said pin chamber in said cylinder.

76. In rekeyable lock apparatus having a housing, a cylinder rotatably positioned in said housing with a longitudinal keyway therein, a pin chamber extending radially from said housing into said cylinder to intersect said keyway, a driver pin slideably positioned in the housing portion of said pin chamber and a service pin slideably positioned in the cylinder portion of said pin chamber, the interface between said cylinder and said housing defining a shear plane, the method of making the lock rekeyable comprising the steps of:

providing a capture hole extending into the cylinder from the peripheral surface thereof an angularly spaced distance from said pin chamber in said cylinder, making said capture hole smaller in diameter than said driver pin;

a positioning a removeable level pin wafer in said pin chamber between said driver pin and said service pin, making said pin wafer of small enough in diameter to be receivable into said capture hole;

positioning a blocking pin wafer larger in diameter than said capture hole in said pin chamber between said level pin wafer and said service pin.

77. The improvement of claim 76, including the steps of opening the lock by positioning the level pin wafer and the blocking wafer below the shear plane, and rotating the cylinder.

78. The improvement of claim 77, including the steps of rekeying the lock by positioning the blocking pin wafer below the shear plane and the level pin wafer above the shear plane, and rotating the cylinder until the level pin wafer drops into the capture hole.

79. The improvement of claim 78, including the steps of providing multiple level rekeying of the lock by positioning a plurality of level pin wafers in said pin chamber between said driver pin and said blocking pin wafer, making said level pin wafers small enough in diameter to be received into said capture hole, and making said capture hole extend deep enough into said cylinder to be able to contain and hold all of said level pin wafers, positioning any selected one of said level pin wafers above the shear plane and the blocking pin wafer below the shear plane, and removing the selected pin wafer by rotating the cylinder until that selected pin wafer drops into the capture hole.

* * * * *